US008985979B2

(12) United States Patent
Didin et al.

(10) Patent No.: US 8,985,979 B2
(45) Date of Patent: Mar. 24, 2015

(54) POSITIVE DISPLACEMENT ROTARY MACHINE

(76) Inventors: Alexandr Vladimirovich Didin, Novaya (RU); Ilya Ykovlevich Yanovsky, Pushkina (RU)

( * ) Notice: Subject to any disclaimer, the term of this patent is extended or adjusted under 35 U.S.C. 154(b) by 219 days.

(21) Appl. No.: 13/635,316

(22) PCT Filed: Mar. 15, 2011

(86) PCT No.: PCT/RU2011/000158

§ 371 (c)(1),
(2), (4) Date: Sep. 14, 2012

(87) PCT Pub. No.: WO2011/115528

PCT Pub. Date: Sep. 22, 2011

(65) Prior Publication Data

US 2013/0011286 A1 Jan. 10, 2013

(30) Foreign Application Priority Data

Mar. 16, 2010 (RU) ..... 2010109516

(51) Int. Cl.

| | |
|---|---|
| ***F01C 3/00*** | (2006.01) |
| ***F03C 2/00*** | (2006.01) |
| ***F03C 4/00*** | (2006.01) |
| ***F04C 18/00*** | (2006.01) |
| ***F01C 3/06*** | (2006.01) |
| ***F01C 11/00*** | (2006.01) |
| ***F01C 21/08*** | (2006.01) |
| ***F01C 21/10*** | (2006.01) |

(52) U.S. Cl.

CPC ..... *F01C 3/06* (2013.01); *F01C 11/002* (2013.01); *F01C 21/08* (2013.01); *F01C 21/10* (2013.01)

USPC ..... 418/68; 418/5; 418/107; 123/18 R

(58) Field of Classification Search

CPC ..... F01C 3/06; F01C 9/00; F01C 9/002; F01C 9/005; F01C 11/002; F01C 21/10; F01C 21/102; F04C 3/06; F04C 9/00; F04C 9/005; F04C 23/001

USPC ..... 418/68, 5, 107; 123/18 R, 241

See application file for complete search history.

(56) References Cited

U.S. PATENT DOCUMENTS

| | | | | |
|---|---|---|---|---|
| 2,708,413 | A * | 5/1955 | Loewen | 418/68 |
| 2009/0185925 | A1 * | 7/2009 | Didin et al. | 418/68 |
| 2009/0185937 | A1 * | 7/2009 | Didin et al. | 418/68 |
| 2010/0224165 | A1 * | 9/2010 | Nagy et al. | 418/68 |

FOREIGN PATENT DOCUMENTS

| | | | | |
|---|---|---|---|---|
| RU | 2202695 | C2 * | 4/2003 | F01C 3/06 |
| RU | 2376478 | C2 * | 12/2009 | F01C 3/06 |

* cited by examiner

*Primary Examiner* — Theresa Trieu

(57) ABSTRACT

A hinged joint is formed on a volumetric rotary machine with a spherical working cavity formed between a spherical rotor part and the spherical surface of the body, between a piston, which is mounted in such a way as to enable rotary oscillations relative to the rotor in the plane passing along the axis of rotation of the rotor, and a rotor, which is mounted in such a way as to enable rotation about the spherical rotor part. This solution has made it possible to increase the reliability, service life and thermal stability of machines of this type. In addition, helical channels for communication between symmetrical working chambers and channels within the rotor for connecting the working chambers to the working-medium inlet and outlet openings are formed inside the spherical rotor part. This solution has made it possible to increase the specific power of the machine.

11 Claims, 40 Drawing Sheets

POSITIVE DISPLACEMENT ROTARY MACHINE

This application is the United States national phase application of International Application PCT/RU2011/000158 filed Mar. 15, 2011, which claims the benefit of Russian Patent application No. RU 2010109516 FILED, Mar. 16, 2010, the entire disclosure of which is incorporated herein by reference.

The invention pertains to machine-building, specifically to rotary positive-displacement machines, which can be used as pumps, hydraulic drives, including controllable ones.

STATE OF THE ART

A positive-displacement rotary machine (PDRM) is known (U.S. Pat. No. 2,708,413 E. Loewen FIG. 18), containing a housing with a sphere-like inner working surface a rotor with a working surface of revolution mounted in the housing with the capability of rotation, a separator made in the form of a flat ring mounted with the capability of turning around an axis which is perpendicular to the axis of the rotor and the separator divides the working cavity into two parts, in addition at the working surface of the rotor two grooves are made along its axis of rotation, in each groove one piston in the form of half a ring is mounted with the capability of closing of the working cavity and the capability of rotary oscillations around its axis intersecting rotor axis. For interaction of the pistons with the separator a sealing element is used made in the form of a flat ring with sections of cylindrical surfaces on one side of the ring with their axes in the plane of the ring. The mating cylindrical areas made on pistons interact with the cylindrical surfaces. Due to the sphere-like form of the working cavity and the use of sealing elements the mating surfaces between working members are areas (not lines) what reduces internal back flows of the working fluid.

However, PDRM is not widely used. The cause is in not reliable mesh of the rotating sealing element with the piston, since all normal lines to cylindrical areas served for meshing (especially areas on pistons) are directed mainly across the separator. As a result, friction force decelerating the sealing element and directed along the separator makes a small angle to the support areas, which produces conditions for jamming. It seems impossible to extend the angular length of the cylindrical areas on the piston and on the both sealing elements to have normal lines oriented mainly along the separator, because of the position and the separator between them and the need to variate the angle between the piston and the separator during the rotor rotation.

A drawback also is the existence of two pairs of inlet openings and outlet openings for working fluid on the housing of each stage and their angular sizes which are not big enough. The last statement deals with the fact that in order to maintain the pressure with one stage of PDRM the length of the inlet openings/outlet openings should not extend the thickness of the piston.

A positive-displacement rotary machine is known (RU 2202695), containing a stator; working chambers; a rotor mounted with the capability of rotation; a separator mounted with the capability of rotation, in which the axes of rotation of the rotor and separator intersect at an acute angle; inlet openings and outlet openings of the working fluid; in which the separator meshes with the rotor through the sealing synchronizing element (SSE) having a through slot through which the rotor passes.

The drawback of the PDRM is in fact that for the SSE fastening its axle should be placed in outer part of the separator which increases the thickness of the separator outer part and consequently its moment of inertia. Since the rotation of the separator is not uniform, the increase of its moment of inertia limits maximal linear velocity at which the PDRM can operate. Besides the main SSE support working against friction force between the separator and the housing is located inside the outer part of the separator while the load application point by friction force is found in the separator recess, so the arm of the SSE support forces is shorter then the arm of load forces. Consequently the load of friction pair SSE axle—separator is increasing and life time is shortening. Another drawback is also that the loaded areas of the SSE prevail over not loaded areas. It makes complicated heat removal and makes the SSE the most vulnerable member of the PDRM in operation with a liquid near oiling point or with temporally leaks of liquid (for example, "dry" start, gaslocks in working fluid flow).

Another drawback is the existence of two pairs of inlet openings and outlet openings for working fluid on the housing of each stage. To connect inlet openings/outlet openings with each other we have to go around the groove of big diameter made for the separator mounting in the housing. It increases the mass and complexity of the housing, decreases the specific parameters of the PDRM. Especially if two stages are used and we have to connect eight inlet/outlet openings. Another drawback is the existence of a flat section of the rotor, which goes through a recess in the sealing synchronizing element. It does not allow to make ducts for working fluid through the rotor, limits maximal working pressure and maximal torque that can be transferred to the next hydraulically parallel stage of the PDRM needed to get more uniform feed.

A positive-displacement rotary machine is known (RU 2376478), containing a housing, the working surface of which is designed in the form of part of a spherical segment, a rotor with a working surface of revolution mounted in the housing with the capability of rotation, an annular concentric working cavity, formed by the housing and rotor, a separator, designed in the form of an inclined washer, set fixed in the housing at an angle to the axis of rotation of the rotor and dividing the working cavity into two parts, at least one groove being made on the working surface of the rotor along its axis of rotation, a piston is mounted in the rotor capability of closing off (sealing) the working cavity and executing rotary oscillations around its axis, which intersects the axis of the rotor, the piston being designed at least in the form of a part of a disk, and there is at least one sealed groove in each piston for passage of the separator.

By using of the sealing synchronizing element (SSE) which axis of rotational oscillations intersects the axis of the piston and axis of the rotor the PDRM has reliable synchronization and boundaries of volumes with different pressures are presented by areas, that reduces internal back flows. Friction pairs in the PDRM also interact by areas and it reduces their load and increases lifetime. Other types of the SSE do not give such advantages. Though for the SSE fastening its axle should go through the piston which leads to increase of thickness of the piston and as consequence to increase of its moment inertia. The latter limits the maximal linear velocity of the piston whereby the PDRM can operate. Besides the main SSE support place, working against the stage pressure difference forces and friction forces between the SSE and separator directed across the piston, is located inside a part of the piston residing inside the rotor, while the point of these forces application is beyond the rotor, that is why the arm of the support forces is shorter than the arm of load forces. As a consequence the maximal pressure withstanding by one stage and lifetime are limited by wear resistance of the friction pair SSE axle—piston. Another drawback is that the loaded areas of the SSE substantial prevail over not loaded areas. It makes complicated heat removal and makes the SSE the most vulnerable member in operation with a liquid near boiling point or with temporally leaks of liquid (for example, "dry" start, gaslocks in working fluid flow). Another drawback is the existence of two pairs of inlet openings and outlet openings for working fluid on the housing of each stage which are to connect by ducts for working fluid around the working cavity.

This PDRM is closest prior air.

The task of the invention is to design the reliable, able to withstand short-time pressure overloads, thermal overloads, compact PDRM with high specific power and long lifetime. A result from this is the need to exclude high loaded friction pairs from the PDRM design.

The PDRM satisfying to those conditions is designed on the basis of the PDRM with sphere-like working cavity.

The task of the invention is achieved in that the positive-displacement rotary machine comprising a housing, a rotor, at least one piston, at least one separator, a sphere-like working cavity formed around the rotor, inlet openings and outlet openings for working fluid, least a part of the piston is mounted with the capability of accomplishing rotary oscillations relative to the rotor in a plane positioned mainly along a rotor axis and at least a part of the separator is mounted with the capability of rotation around the rotor, and the piston or a part of the piston is hinge joint with the separator or with a part of the separator.

The hinge joint of the piston with the rotated separator can be made reliable and all members have enough spaces for heat removal from friction pairs. The most loaded in the prior art friction pairs—SSE axle are not present in this design. In addition the reliability is increased due to excluding of small members—the SSE.

The task of the invention is achieved in that hinge joints on the piston and on the separator are made in the form of combination of a cylindrical thickening and a slot with coaxial to the thickening concave cylindrical areas.

The task of the invention is also achieved in that hinge joints on the piston is made in the form at an arc-shaped bent and on the separator is made in the form of an arc-shaped slot.

The task of the invention is also achieved in that hinge joints on the piston is made in the form of an arc-shaped slot and on the separator is made in the form of arc-shaped bent.

The task of the invention is achieved in that inside rotor ducts for working fluid which are leading from one side to the other side of the separator to make it possible to supply and/or discharge the working fluid to/from the working cameras only from one side of the separator.

The task of the invention is achieved in that the separator is mounted with the possibility of variation of its inclination angle to rotation of the rotor to control the machine feed.

The task of the invention is achieved in that there is a ball-shaped part positioned concentrically in the sphere-like cavity, and the inlet opening and the outlet opening are made at the ball-shaped part at the different sides of the piston.

The task of the invention is achieved in that the separator except a rotating around the rotor part has a static part that reducing the load on the rotating part.

The task of the invention is achieved in that there is an additional piston and for interaction with it the separator contains movable to one another parts.

The invention is explained by means of drawings.

All figures contain isometric projections.

DESCRIPTION OF EMBODIMENT

Figure 1:
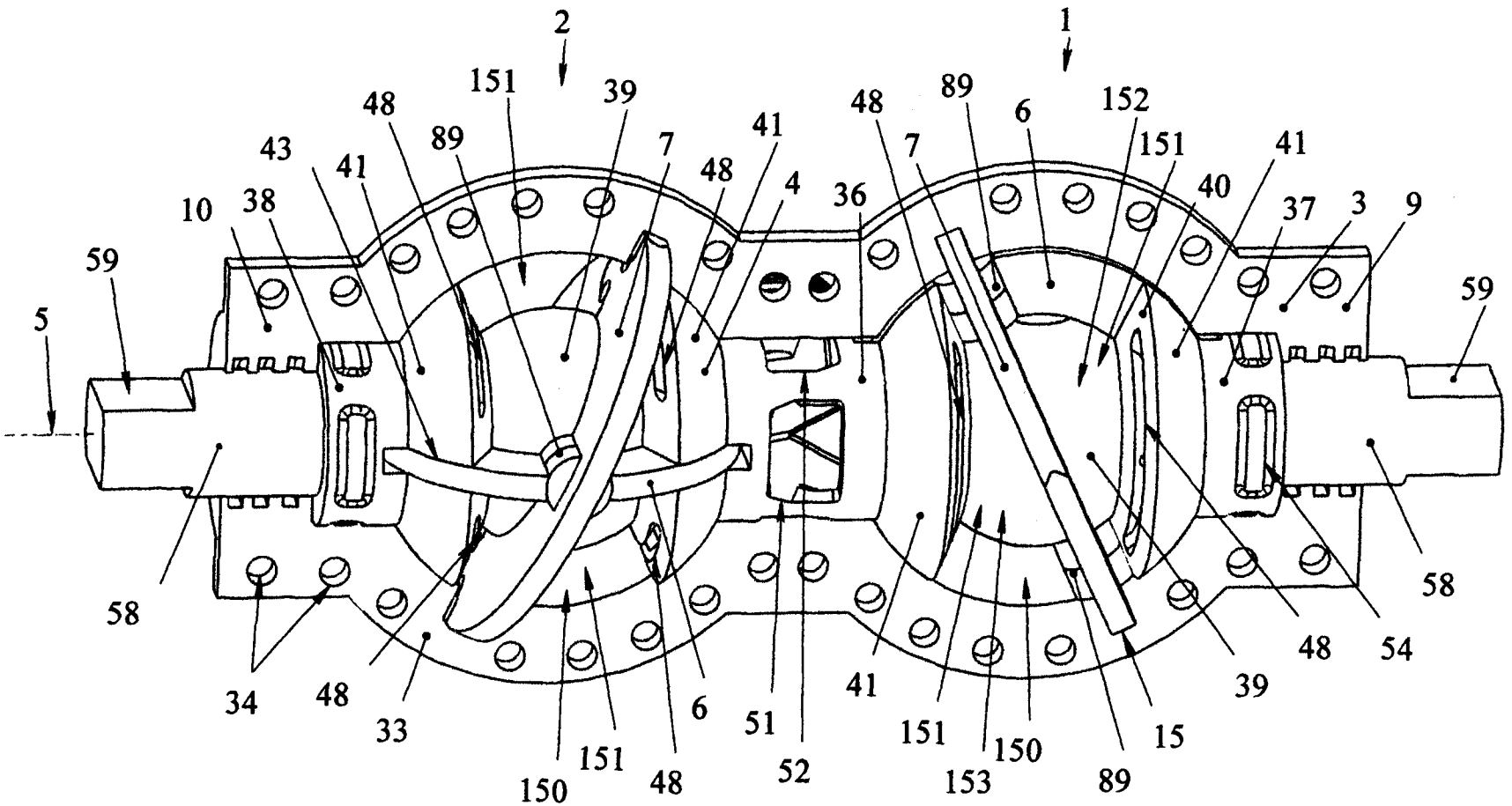
FIG. 1 shows a two-staged positive-displacement rotary machine (PDRM). The nearest housing part is removed.

To simplify the description we will introduce some definitions.

Sphere-like surface is understood to mean a surface similar to a sphere or part of a sphere, permitting slight deviations from an ideal sphere, related to imprecision of manufacture, the need to ensure working gaps, with the design of seals, gaps to reduce viscous friction, etc.

Sphere-like cavity is understood to mean a cavity in which at least one of the surfaces bounding it is a sphere-like surface.

Ball-shaped part is understood to mean a part similar to a ball or part of a ball permitting slight deviations from an ideal ball, related to impression of manufacture, the need to ensure working gaps, with the design of seals, gaps to reduce viscous friction, etc.

Passages of various shape for the working fluid made within or along the surface of a part, for example, holes, grooves, cavities obtained by casting or other methods in which no working member moves, will be called ducts.

One or more surface sections of one part with a working gap from which during operation there is a constant or periodic possibility of presence the surface of the second part will be called a region of interaction of two parts.

The gap between two parts in which they have the capability of relative movement but leaks of the working fluid through it are absent or within permissible limits for the given device owing to the smallness of the gap or owing to positioning of sealing elements in it will be called working gap.

We will state that two parts interact with each other, if they have a region of interaction in them.

A piston is a member of the PDRM which separates cameras with different pressures and transmits the main torque and energy between the rotor or shaft of the rotor and working fluid.

A separator is a member of the PDRM which separates cameras with different pressures and does not transmit the main torque and energy between the rotor or shaft of the rotor and working fluid. The separator via the piston or the working fluid receives from the rotor (interchanges with the rotor) the torque needed to compensate the friction forces and not uniform rotation. The separator can comprise movable parts with respect to each other.

With identical numbers can designate functionally similar elements in the description.

The positive-displacement rotary machine (PDRM) (FIG. 1) can be used as a pump or a hydraulic drive. It consists of two stages 1 and 2. Stages 1 and 2 have common housing 3 and common rotor 4 mounted in the housing 3 with the capability of rotation. Axis of the rotor 4 rotation is the axis of the PDRM. In each stage the piston 6 is mounted with capability of performing rotational oscillations relative to the rotor 4 in a plane oriented mainly along axis 5 of the rotor 4, and the separator 7 is mounted with the capability of rotation around the rotor 4.

To be definite, we will describe tile PDRM operation by using it as a pump on the assumption with that if the rotor 4 is shown at the figures than as direction of rotation is counterclockwise while looking from the left.

Figure 3:
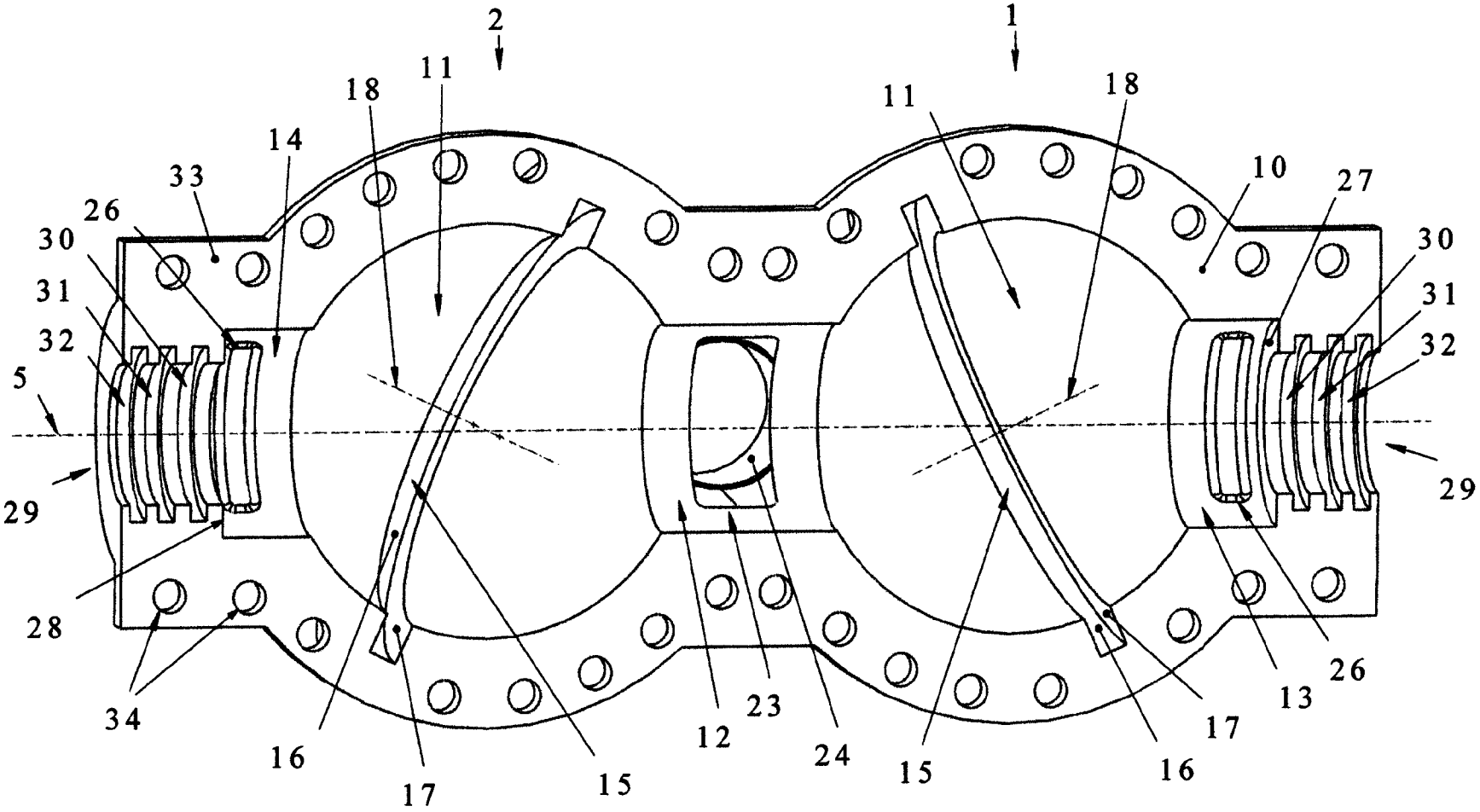
FIG. 3 shows the housing part that is absent at FIG. 1.

The housing 3 of the PDRM is made from the two almost (up to fastening elements and grooves for sealing) mirror symmetric parts 8 and 9 (FIG. 3, 4). Mating plane 10 between them contains axis 5 of rotor 4 rotation. There are two sphere-like cavities 11 (one cavity per one stage) in the housing 3 with their centers at the axis 5. (Coaxial to the axis 5 through the cavities 11 is made a cylindrical hole for the rotor 4. The cavities 11 divide it into three sections: middle section 12 between the cavities 11, and two end sections 13 and 14 outstanding beyond the cavities 11 in the opposite directions.

Figure 2:
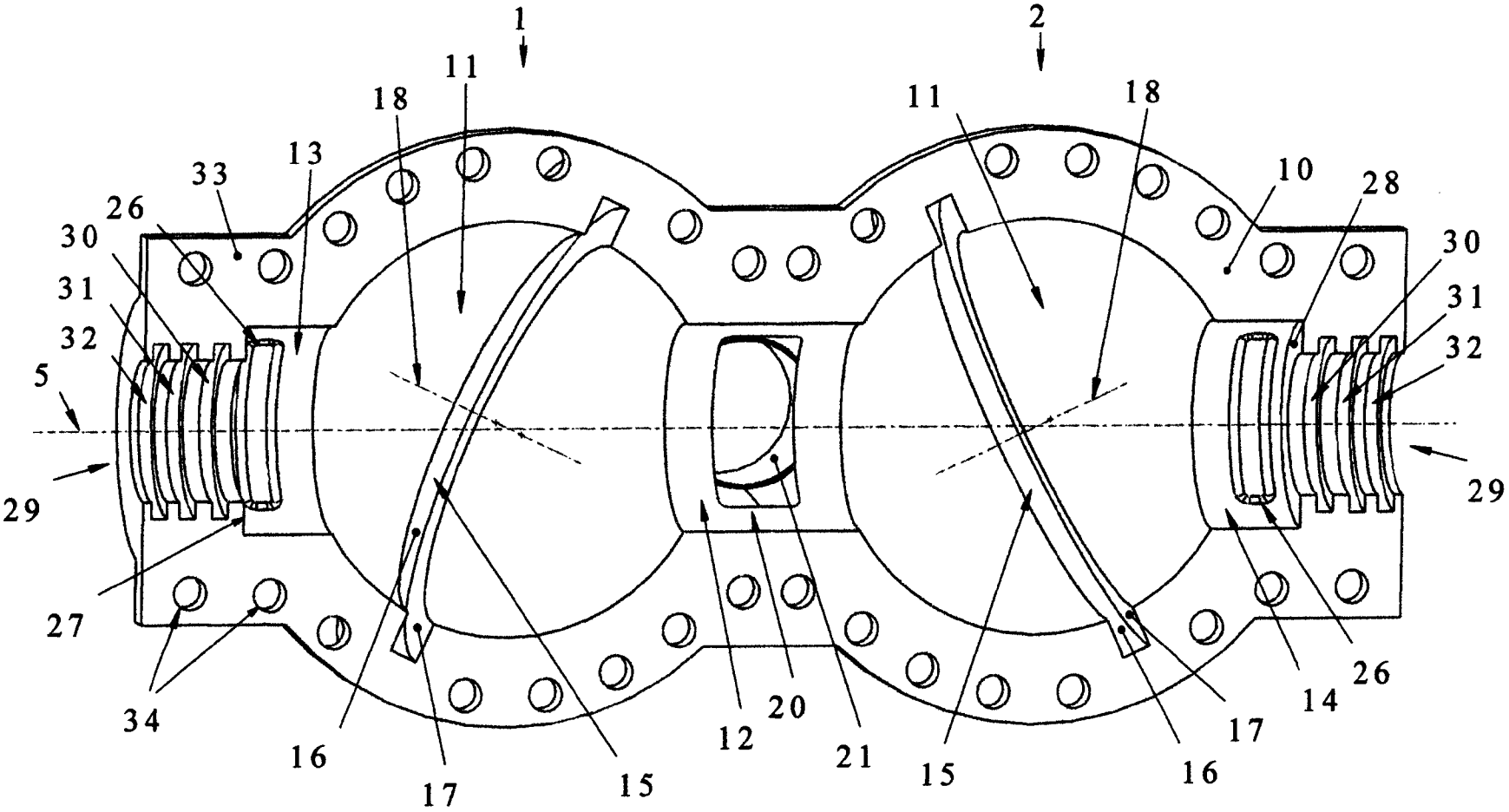
FIG. 2 shows the housing part which is present at FIG. 1.

Around each sphere-like cavity 11 there is a circular slot 15 of larger outer diameter than the diameter of the cavity 11 symmetrically located there and opened inside the cavity 11. I.e. the slot 15 is made in the surface of the cavity 11. Slot 15 is bounded by side sphere-like surface 16 (FIG. 2, 3) which center coincides with the center of the cavity 11 and with two end faces 17 in the form of the symmetrically situated parallel flat rings. Symmetry axis 18 (slot 15 generatrix rotation axis) oriented in this embodiment at an angle of 25 degrees to axis 5 and lies in the mating plane 10.

Figure 4:
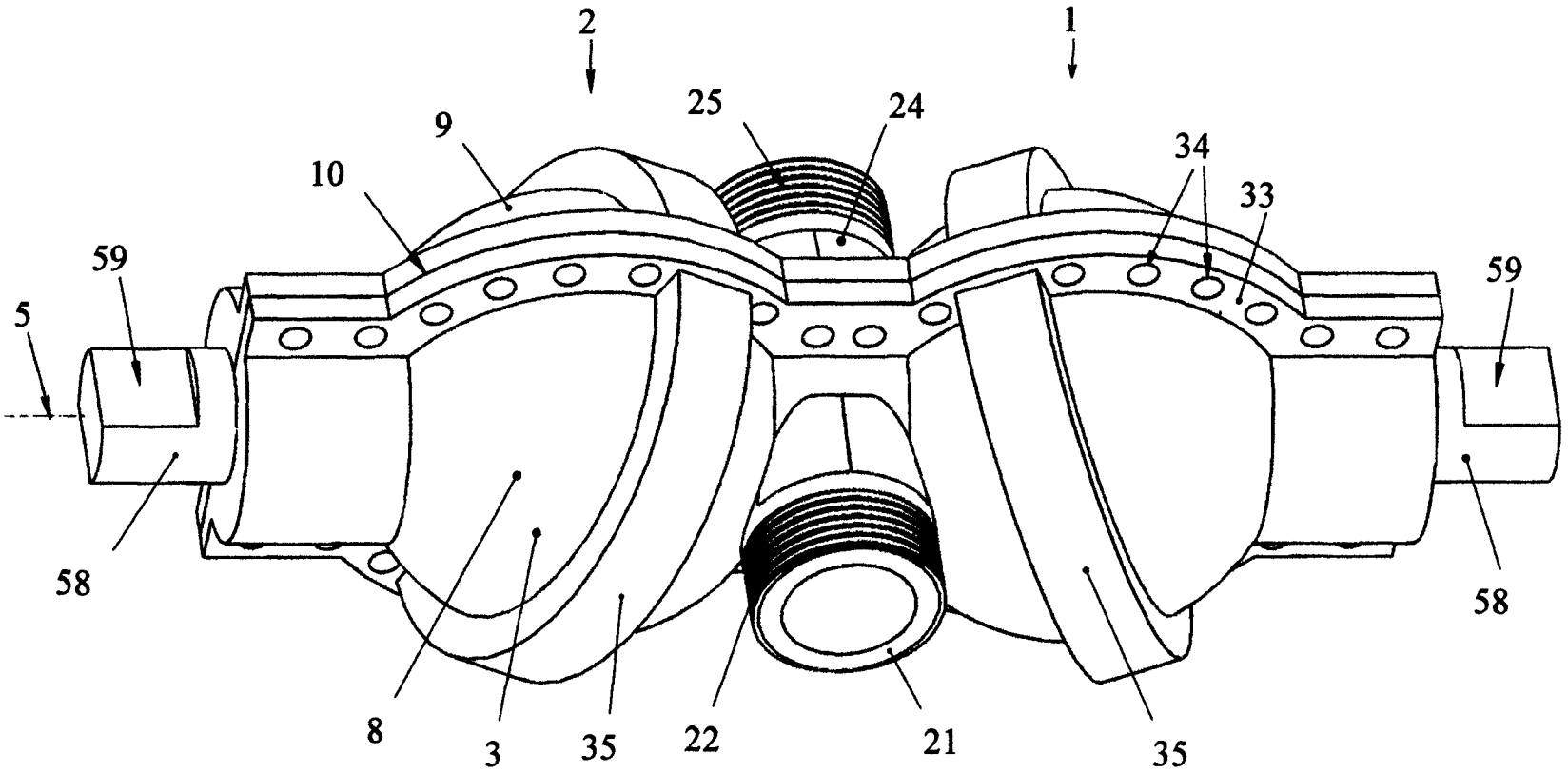
FIG. 4 shows an external appearance of the PDRM.

At the middle section 12 of the cylindrical hole symmetrically between the cavities 11 and symmetrically to a plane coincident with axis 5 and perpendicular to plane 10 an inlet of the opening 20 for working fluid is located (FIG. 2) at one part 8 (not shown at FIG. 1) of housing 3. The inlet opening 20 has rectangular outlines with rounded corners. It has angular length more than turn ¼ turn around axis 5 (106 degrees in this embodiment). The inlet opening 20 transforms into the inlet cylindrical branch pipe 21 of the working fluid inlet with the thread 22 at the end FIG. 4) for connection to supply pipes. At the second part 9 of the housing 3 symmetrically to mating plane 10 there is tie similar outlet openings 23 for working fluid (FIG. 3) transforming into similar outlet branch pipe 24 with the thread 25 at the end (FIG. 4) for connection to discharge pipes.

Sections 13 and 14 of cylindrical hole serve as slide bearings for the rotor 4. On their surfaces in the first part 8 of the housing 3 there are unloading grooves 26 (FIG. 2) in the form of rectangular (in cylindrical coordinates system) closed contours with rounded corners. In terms of an angular length around axis 5 at outer border they are equal to angular length of the inlet opening 20. In terms of a length along axis 5 each contour is approximately equal to one half of analogues size of the inlet opening 20. The grooves 26 of the both contours are connected by pipes of small diameter (not shown) that are laying along outer surface of the housing 3 with outlet opening 23 on the second part 9 of the housing 3 (FIG. 3). Symmetrically at the second part 9 of the housing 3 on surfaces of the sections 13 and 14 are similar grooves 26 in the form of closed contours connected by pipes to inlet opening 20 at limiting of rotor 4 shift in axial direction.

On the end face 27 from the cylindrical section 13 there is the coaxial to axis 5 outlet hole 29 of smaller diameter. There is the annular groove 30 in it used for discharge of leakages from the high pressure area to the low (inlet) pressure area connected by pipes of small diameter (not shown) through cheek valves to the inlet opening 20 and outlet opening 23. Further from the cavity 11 in the hole 29 there is a annular groove 32 for collecting of leakages from the low pressure area(from groove 30) that get through the sealing elements. It is needed in order to operate the PDRM in a closed contour with increased inlet pressure. The analogous outlet hole 29 with the similar grooves 30, 31, 32 is on the end surface 28. There is the flange 33 on the mating perimeter of the housing 3 on the both its parts 8 and 9 to connect them with each other. On the flange 33 the grooves also are made (not shown) for sealing of the fixed mating, which are bordering on the perimeter of the inner cavity of the housing 3.

The outer surface of housing 3 (FIG. 4) with a shift approximately repeats the form of its inner cavity. The lobe 35 is formed around the groove 15.

Manufacturing of the housing parts for the PDRM of high pressure by casting with the following finishing by electro-erosion method.

Stages 1 and 2 of rotor 4 (FIG. 5) are made on one cylindrical axle. They divide it in three sections: middle section 36 and two end sections 37 and 38, which are in the outward directions from the stages 1 and 2. Each stage of the rotor 4 has central ball-shaped part 39 with the center on axis 5 with the diameter which is close to the axle diameter. Side walls 40 are located from the opposite along axis 5 sides made as truncated cones, which are coaxial to the axis 5 and symmetrical rested against the ball-shaped part 39 with their smaller base stands. The side walls 40 are connected to the sections 36 and 37 on the stage 1 and sections 36 and 38 on stage 2 with transition sections 41 that have sphere-like surfaces which diameter larger than the axle diameter and their centers coincide with the centers of the corresponding central ball-shaped parts 39. There is opened ring cavity 42 to outside between two side walls 40 of each stage, and its bottom is the ball-shaped surface of the part 39. Along the axis 5 through the side walls 40, transition sections 41 on the ball-shaped part 39 the groove 43 is made for piston 6. The groove 43 gets in for a not large depth in the ball-shaped part 39 as ring groove and its geometrical center coincides with the center of the ball-shaped part 39. For convenience of manufacturing of the grooves 43 touch the sections 36, 37, 38. The groove 43 looks like as symmetrical through rectangular groove through the rotor 4 except the cylinder 47 that is remained in the ball-shaped part 39. The end face surfaces 44 of the groove 43 are flat and parallel to the axis 5. The grooves 43 divide the ring cavity 42 into two parts 46. The stage 2 is turned regarding to stage 1 on ¼ of revolution around the axis 5. Symmetrically regarding to the groove 43 through the side walls 40 surface the outlets 48 of the duct to working fluid passing into the rotor go out. There are two symmetrical screw-shaped (screw-like) ducts 49 (FIG. 6) of double thread type with large thread pitch inside the central ball-shaped part 39 and each of them connects two ducts 48 located in the different side walls 40 ad going out to the different parts 46 (FIG. 1) of the ring cavity 42. The duct 50 in passing out from each screw duct 49 on the surface of section 36, which outlet has the form close to rectangle or trapezoid (in cylindrical coordinates system), turned by the larger base stand to its stage ½ with round corners. We will call such outlets from stage 1 openings 51 and openings 52 from the stage 2. The openings 51 and 52 have an angular length around the axis 5 less than ¼ revolution and going out approximately to one and the same area of the section 36 aligned with the position of the openings 20 and 23 along the axis 5 on the housing 3. Symmetrically regarding to axis 5 two openings 51 are located and with turn by ¼ of revolution symmetrically located two opening 52. The ducts 49 have a sectional view in the form of miner part of the circle out off by chord with rounded corners. According to function of the ducts 49 it is more correct to state that each duct 49 is transferring the working fluid from one side from the ball-shaped part 39 to the opposite side (or to its center) and further it is passing into the duct 50 which leads to the inlet openings 20/outlet openings 23 of the working fluid, Meanwhile on their way (in the mating area or somewhere else) one more duct 48 is connecting on the opposite from the first duct 48 side relating to the center of ball-shaped part 39 (also on the opposite side of the groove 43). The duct outlets 48 have large enough angular length (in this embodiment more than 90 degrees) and that is why the strengthening ribs 53 (FIG. 5) are left in them. The grooves 54 in fours are made in the form of rectangular (in cylindrical coordinates system) with rounded corners outlines, which have angular length around the axis 5 equal to angular length of the openings 51 and 52 and the length along the axis 5 that is equal approximately half of the corresponding length of the openings 51 and 52 on the surfaces of the sections 37 and 38. Their position along axis 5 coincides with the position of grooves 26 on the housing 3 and the angular position coincides with the position of the openings 51 and 52. They serve as a simulator of the openings 51 and 52 and together with grooves 26 make the hydraulic unloading of the rotor 4.

The end faces 55 and 56 of sections 37 and 38 correspondingly serve as axial hearing for limiting of the rotor 4 movement in the axle direction. The output shafts 58 are extending from the end faces 55, 56. One of them is used for connection with the drive and the other for connection of any add-on equipment. On the output shafts 58 the flats (splines) 59 are made.

It is supposed the manufacturing of rotor 4 by casting with the following finishing by electroerosion method. To simplify the manufacturing of the ducts inside rotor 4, the holes can be made in the central part of the end faces 55, 56 which are coaxial to axis 5 and regarding to depth reach the screw ducts 49. Then the output shafts 58, which are produced separately, are pressing-in into these holes.

The separator 7 (FIG. 7) has the form of the body of revolution—symmetrical ring, Conventionally one can mark its inner part 60 (i.e. the nearest to its centre axis) and outer (i.e. the farthest from its centre) part 61. On the figures they are separated by a line-and-dash circle. The outer part 61 in the assembled PDRM is located in the groove 15 and the inner part 60 is located in the cavity 11. The axis 62 is the axis of the ring geneatrix revolution. The central hole 63 in the ring is limited by sphere-like surface and it has a diameter close to the diameter of the ball-shaped part 39 of the rotor 4 of the separator 7 for mounting on it with the minimal gape that allows them their relative rotation. The outer side face 64 of the ring is limited by sphere-like surface that is concentric to the central hole 63 which diameter is close to the diameter at the sphere-like surface 16 of housing 3. The end faces 66 of the separator 7 are flat. The outside part 63 serves to interact with the groove 15 of housing 3 and on the inside part 60 two coaxial hinge joints 65 are made. The hinged joint 65 is made as a blind hole that is going through the surface of the hole 63 from the separator 7 centre which axis 67 is laying in the separator 7 plane. The hole diameter is lager than thickness of separator 7 that is why the hole on the separator 7 is forming a through she 68 limited by two cylindrical areas 69 which are produced from the hole and bottom of the hole. There is a local thickening 70 of the same diameter coaxial to it at the end of the hole. The cylindrical thickening 70 means two projections in the different sides (end faces 66) of the separator 7 coaxial convex cylindrical areas. The bottom of the hole is flat. It is an end face 71 of the thickening 70. On the end face 71 of the thickening 70 there is closed coaxial to the thickening 70 hole 72 of smaller diameter. The other end face 73 of the cylindrical thickening 70 is concentric to the hole 63 sphere-like surface going alone the border lines of the inner part 60 and outer part 61. The basic meaning of the thickening 70 is that it makes cylindrical convex areas working as friction pair with the piston 6. The separator 7 is central symmetrical.

Figure 8:
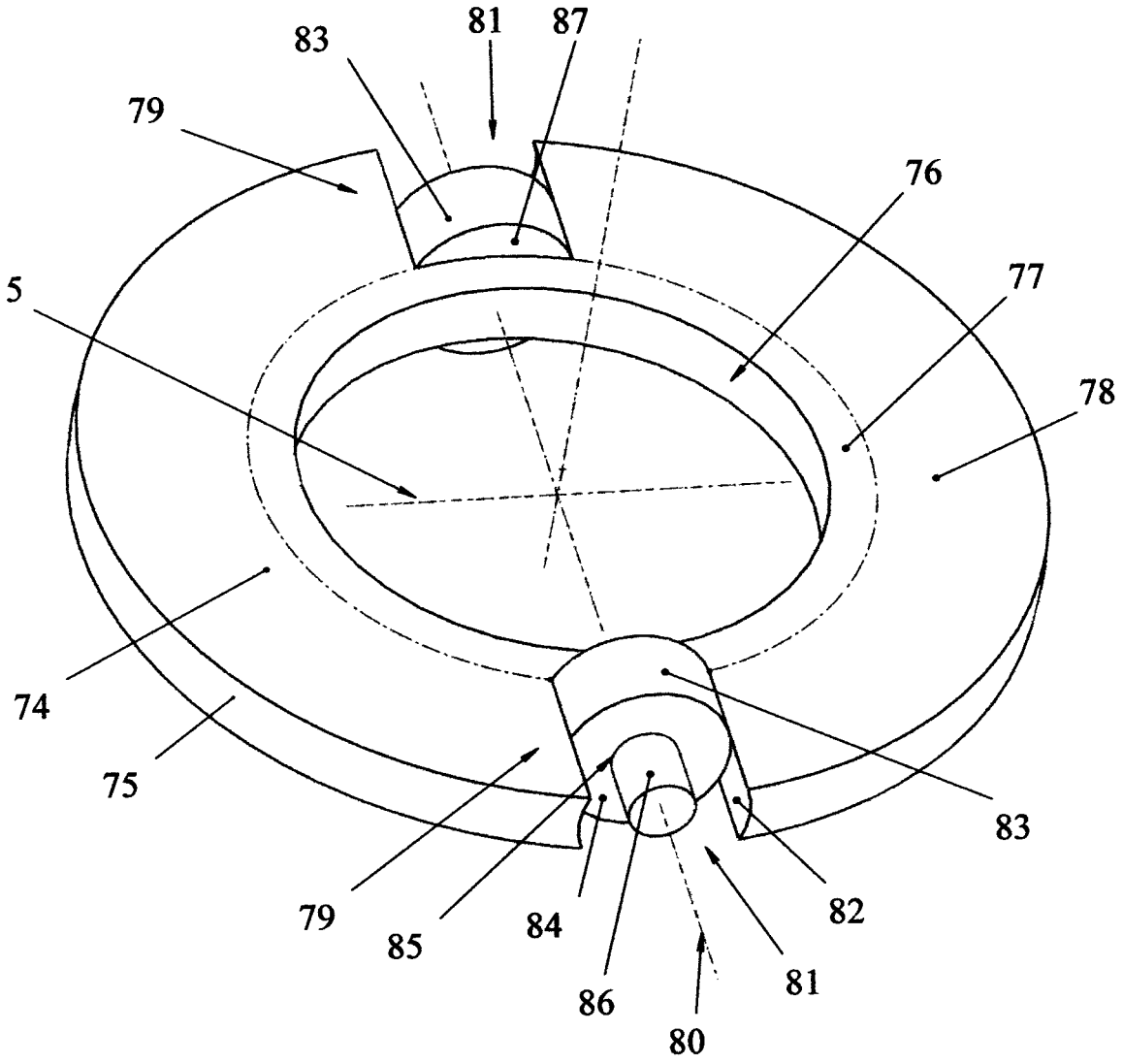
FIG. 8 shows a piston.

The piston 6 (FIG. 8) is made as a flat ring. The end faces 74 of the ring are flat, the outer side face 75 is limited by sphere-like surface with diameter that is close to the diameter of the cavity 11 for the capability of rotation in latter without large gapes. The surface of the hole 76 is cylindrical. The piton 6 conventionally can be divided on inner (the nearest to the ring axis) part 77 and outer (peripheral) part 78. The inner part 77 does not extend from the groove 43. On the outer part 78 symmetrically made two coaxial hinge joints 79. The hinge joint 79 is made as blind hole which is going through the side face 75 in the direction to the center of piston 6 which axis 80 is laying in the plane of the piston 6. The diameter of the hole is larger than the thickness of the piston 6, therefore the hole on the piston 6 is forming the through slot 81 limited by two cylindrical areas 82 left from the hole, and bottom of the hole. At the end of the hole there is coaxial cylindrical thickening 83 of the same diameter. The thickening 83 consists of two projection in the different directions (end faces 74) from the piston 6 coaxial to cylindrical areas which axis is directed to the center of the piston 6. The flat bottom of the hole is to end face 84 of the thickening 83. On the end face 84 of the thickening 83 there is the blind hole 85 coaxial to it of smaller diameter from which the pressed-in axle 86 projects. It is using for increasing of supporting surfaces of the hinge joints 79. The other end face 87 of the cylindrical thickening 83 is the concentric to the side face 75 concave sphere-like surface which is going along border lines of the inner part 77 and outer part 78 of the piston 6. The basic meaning of the thickening 83 is that it creates cylindrical convex areas working as friction pair with the separator 7. The piston 6 is central symmetrical.

Figure 9:
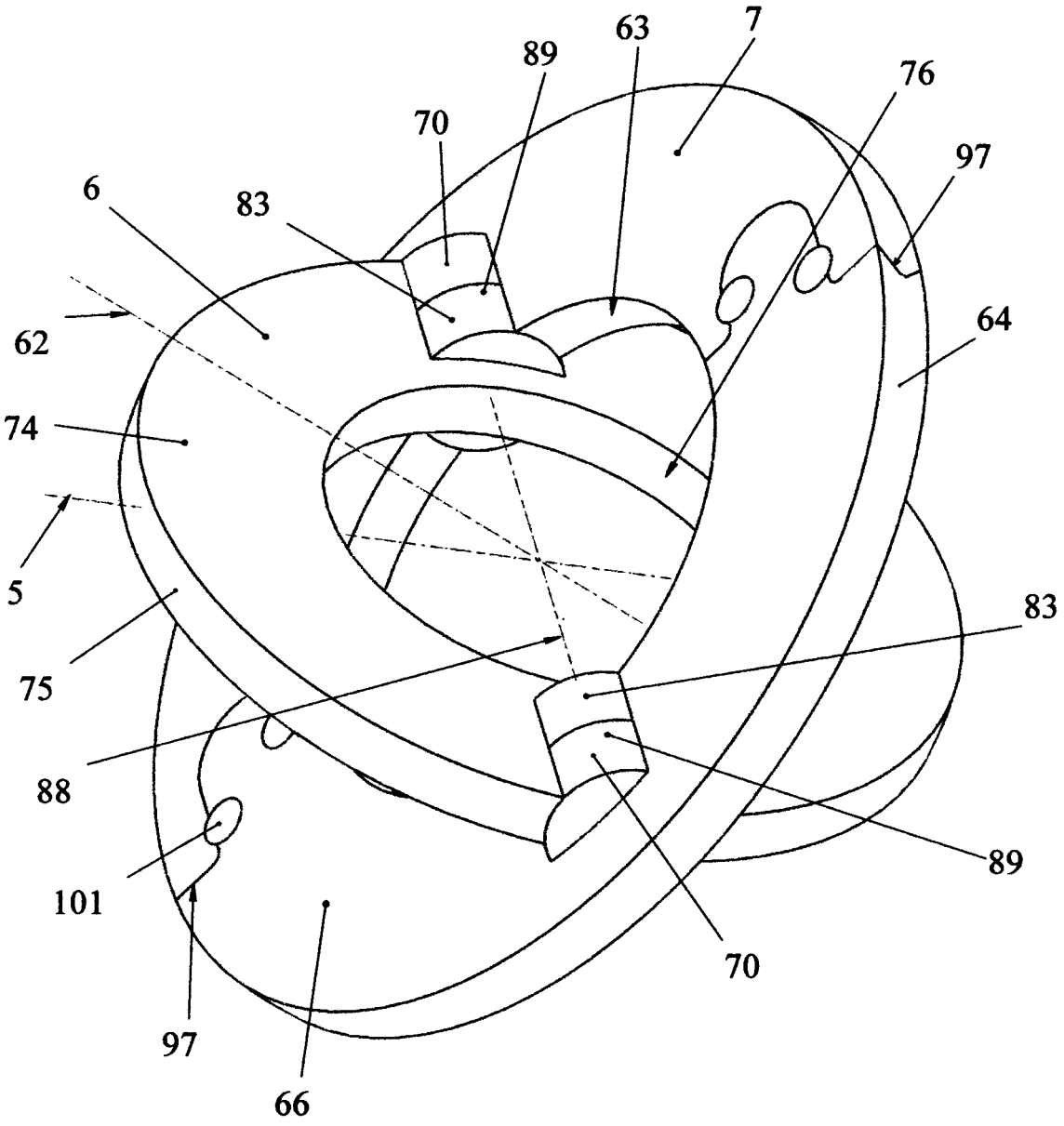
FIG. 9 shows a hinge joint between the piston and the separator.

Assembled the thickening 83 of the piston 6 enters into slot 68 of the separator 7 (FIG. 9) and the thickening 70 of the separator 7 enters into slot 81 of the piston 6. The axis 80 enters into the hole 72. Cylindrical areas 82 of the slot 81 of the piston 6 are working as friction pair against cylindrical thickening 70 of the separator 7 taking over mainly the loads acting in the plane of the piston 6 perpendicular to the axis 88 of the hinge joint 89. The cylindrical areas 69 of slot 68 of the piston 7 are working as friction pair against cylindrical thickening 83 of the piston 6 taking over mainly the loads acting in the plane of separator 7 perpendicular to the axis 88 of the hinge joint 89. The loads acting along the axis 88 is taking up by the friction pair the end face 84 of thickening 83 of piston 6—the end face 71 of thickening 70 of the separator. 7. The friction pairs piston 6—rotor 4 and housing, 3—separator 7 take op all other loads.

Figure 10:
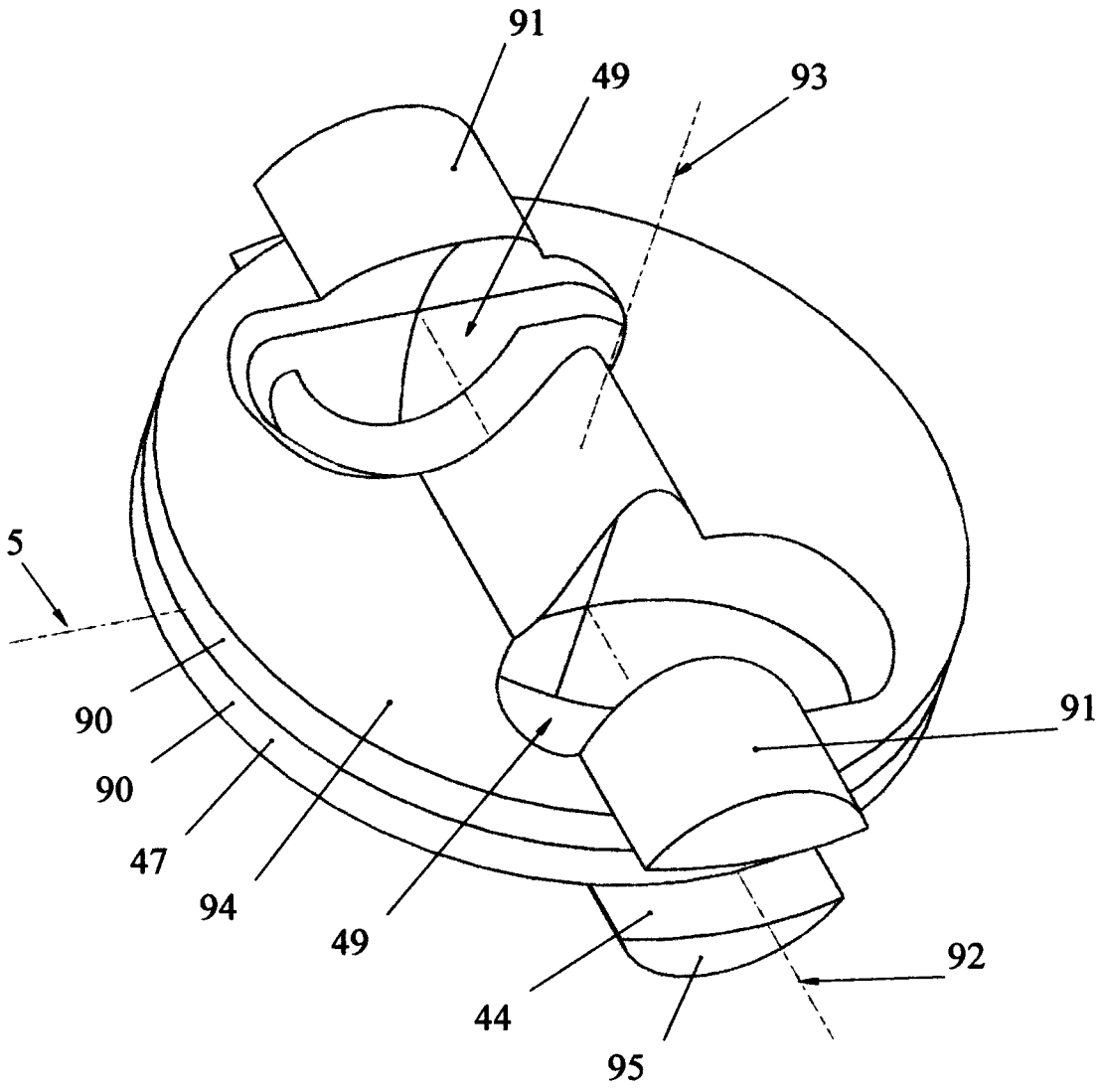
FIG. 10 shows inserts of the rotor.
Figure 11:
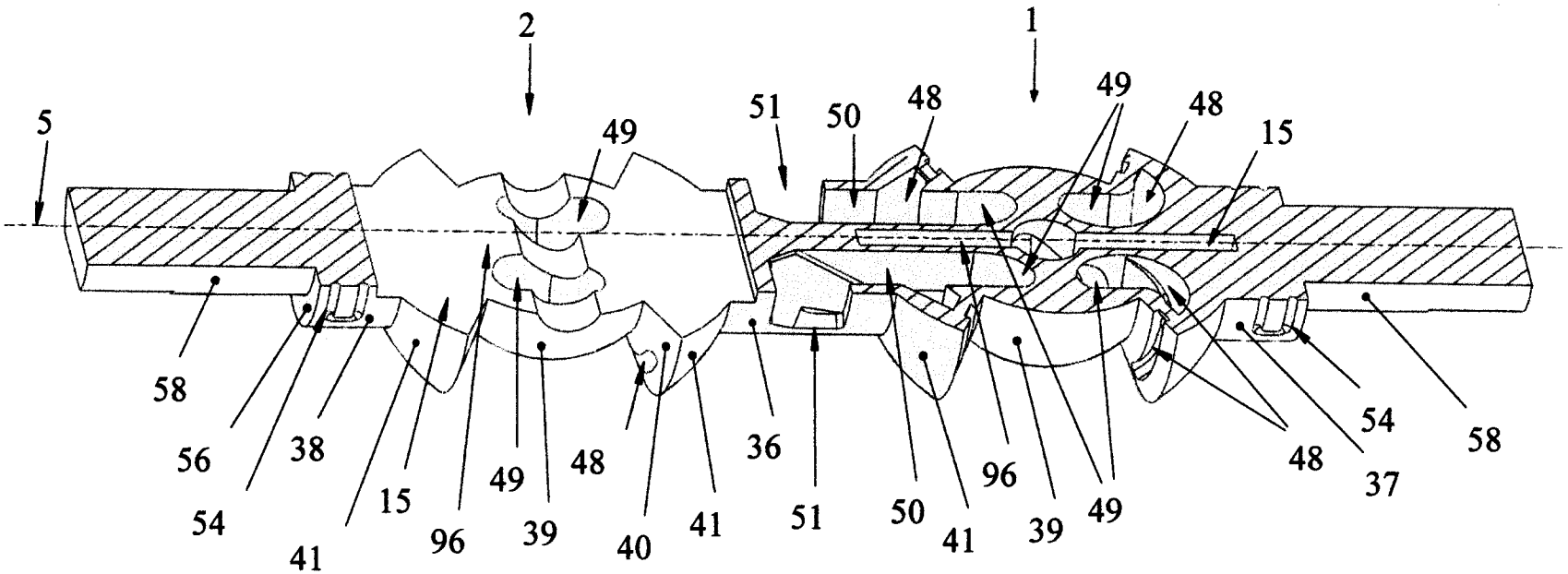
FIG. 11 shows the rotor with ½ cut off.

For capability of the piston 6 mounting into the rotor 4 the rotor 4 is made assembled. As separate parts—inserts 90 (FIG. 10) is separated a cylinder 47 with connected to it cylindrical bulges 91, which axis 92 is perpendicular to the axis 93 of the cylinder 47 and go through its center. The insert 90 is a half of the cylinder 47 with its part of bulge 91. The separation is going in the plane which is parallel to the end faces 94 of the cylinder 47. The bulge 91 is extending beyond the diameter of cylinder 47 and its end face 95 has a section (part) of the ball-shaped part 39 surface. The ducts sections 49 passing through the cylinder 47 also fall into the inserts 90. The through slot 96 (FIG. 11) is forming in the rotor 4 on the position of the groove 43 as a combination of symmetrically positioned rectangle and hole.

During assembly the inserts 90 are inserting into the hole 76 of the piston 6 from both sides, their bulges 91 are mounting parallel to the thickenings 83 of piston 6 and all together are mounting into the slot 96 of rotor 4. The piston 6 is coming at that into the slot 90 with sliding fit and inserts 90 are pressing-in.

For capability of mounting of the separator 7 on the rotor 4, the separator 7 (FIG. 7) is made from two c-shaped parts, the joint 97 between which is made according to type "bulge into groove". On the diametrically opposite areas of one part there are bulges 98 and on the other part are grooves 99. There is a v-shaped groove 100 outlines of the bulge 98 and along the groove 99 outline the chamfers are made. The bulge 98 can in the groove 99 only in one direction—along the axis 67 of the hinge joint 65. During assembly for complete fixing of the separator 7 parts the pins 100 are mounting into the holes at the boundary line the bulge 98—groove 99.

Figure 12:
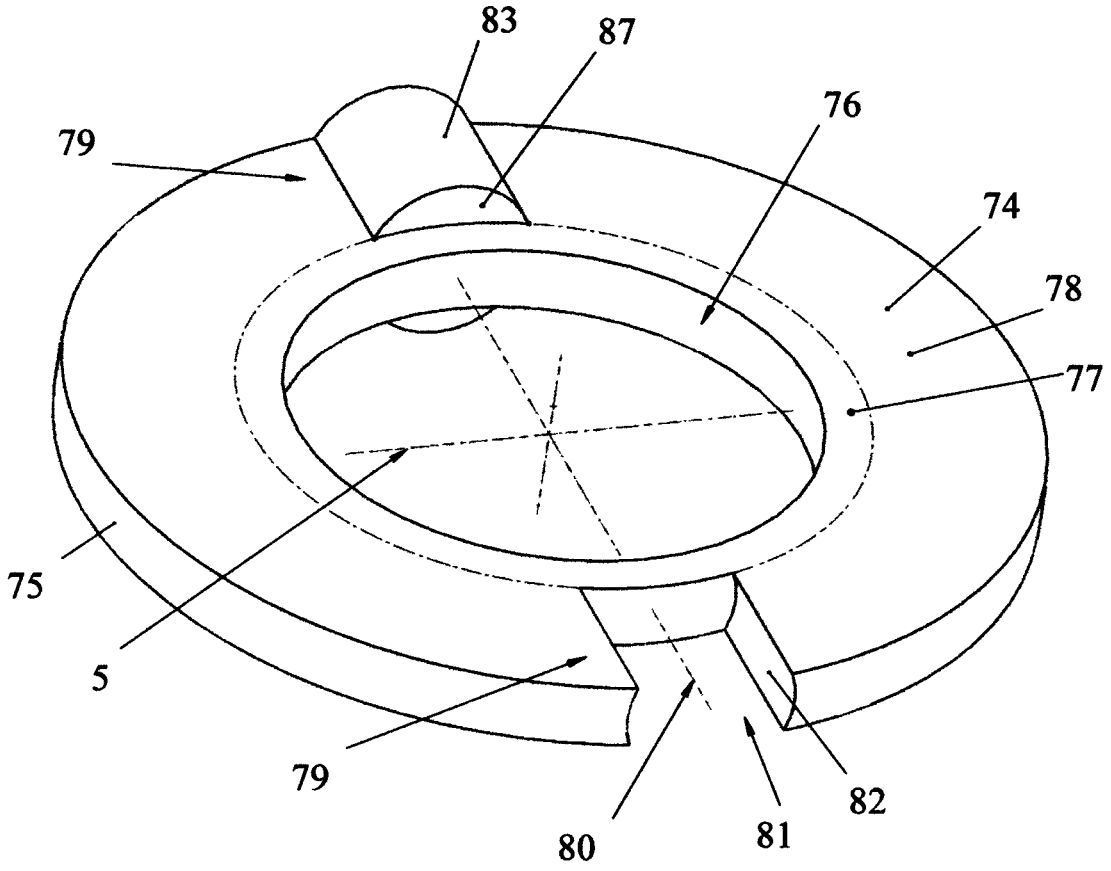
FIG. 12 shows a piston with asymmetric hinge joint.
Figure 13:
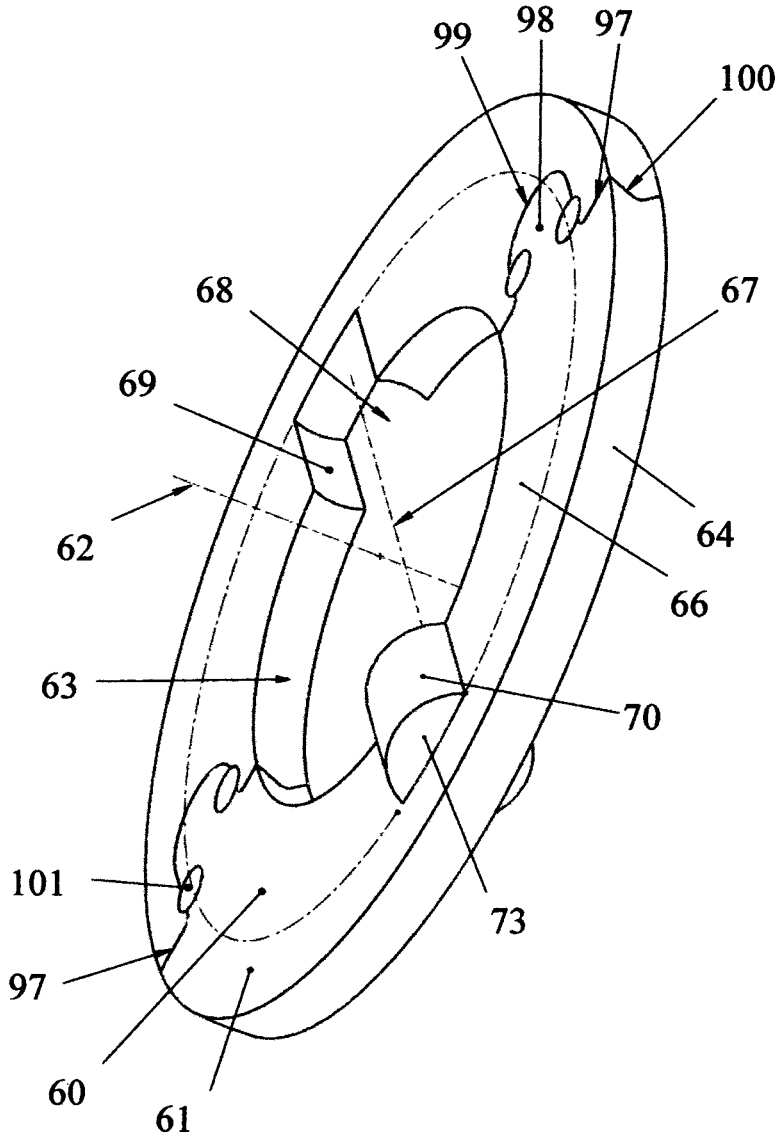
FIG. 13 shows a separator with asymmetric hinge joint.

For simplification of manufacturing (FIG. 12) the thickenings 83 on the piston 6 can be moved to one side of the piston 6 and the slots 81 to the other side of the piston 6. Instead of thickenings 83 and slot 81 from one side of the piston 6 it will be longer thickening 83, and from the other side of the piston 6 instead of the thickening 83 and slot 81 will be the longer slot 81. Thereby analogous changes also take place on the separator 7 (FIG. 13). Instead of the thickening 70 and slot 68 from one side of the separator 7 the longer thickening 70 is manufacturing and from the other side of separator 7 instead of the thickening 70 and slot 68 the longer slot 68 is manufacturing. Since the piston 6 and the separator 7 are holding from movements by other friction pairs (piston 6—rotor 4, separator 7—housing 3) then for transferring them the torque relative to their rotation axes it is sufficient of the cylindrical areas 69 from one side of the piston 6 and the cylindrical areas 82 from one side of the separator 7. One hinge joint 89 with thickening 70 and slot 81 controls the rotation at the piston 6 and the other hinge joint 89 with thickening 83 and slot 68 controls the rotation of the separator 7. Thereby the insert 90 is made in the form of the cylinder 47 without bulges 91.

Figure 14:
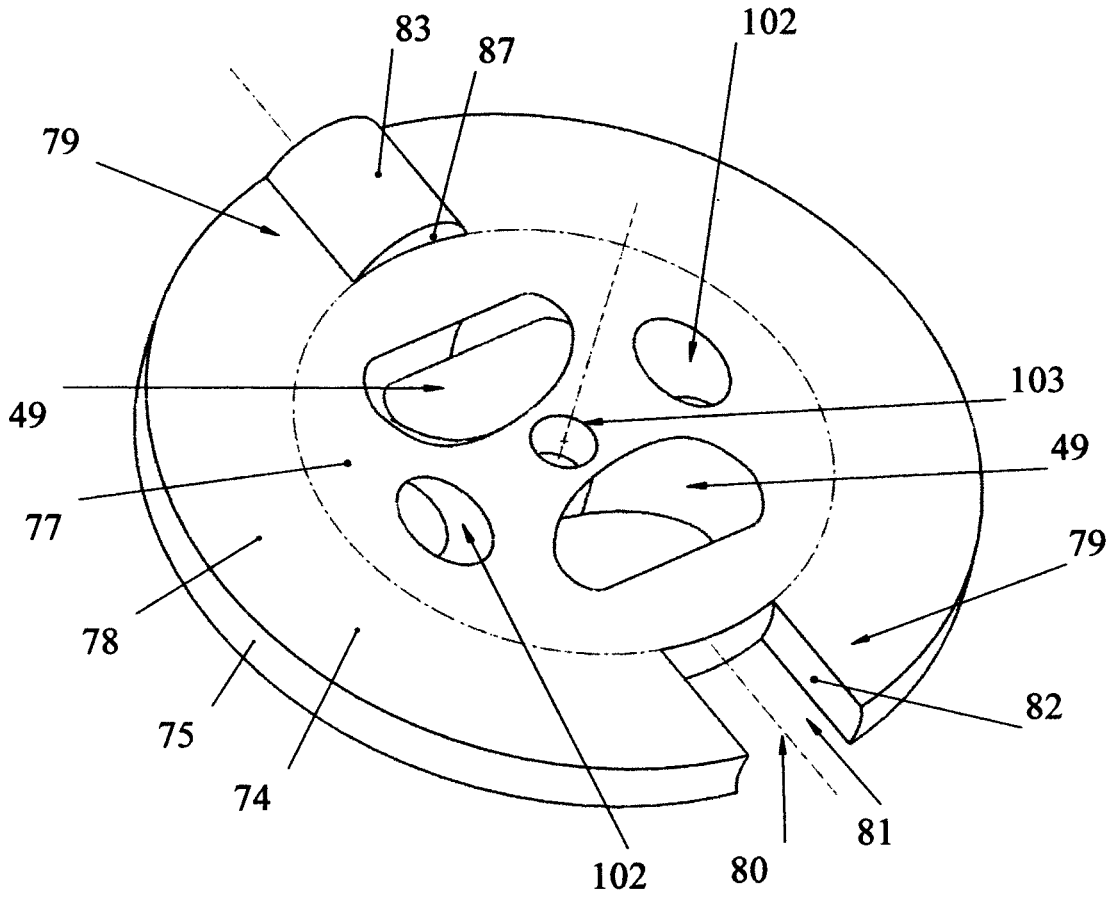
FIG. 14 shows an enforced embodiment of the piston.

For strengthening of the piston 6 and for increasing its bearing area on the rotor 4, piston 6 (FIG. 14) is made as a disk (not a ring). I.e. the cylinder 47 is a part of the piston 6 but not the rotor 4. Meanwhile sections of ducts 49 are also relocated to the piston 6. When the piston 6 turns around the ducts 49 are closed partially by the piston 6 but area of passage is decreasing proportionally to reducing of the working fluid flow through them. In order to reduce the resistance to the working fluid, on the piston 6 between sections of ducts 49 additionally separate holes 102 for passage of the working fluid passing through the ducts 49 are made. When the piston 6 turns around the holes 102 change each other passing the working fluid, but their total area changes slightly. For more strengthening of the piston 6 the large holes on the piston which are corresponding to sections ducts 49 can be changed by the set of smaller holes 102. In the center of the piston 6 the hole 103 is made for the axis of the piston 6.

Figure 7:
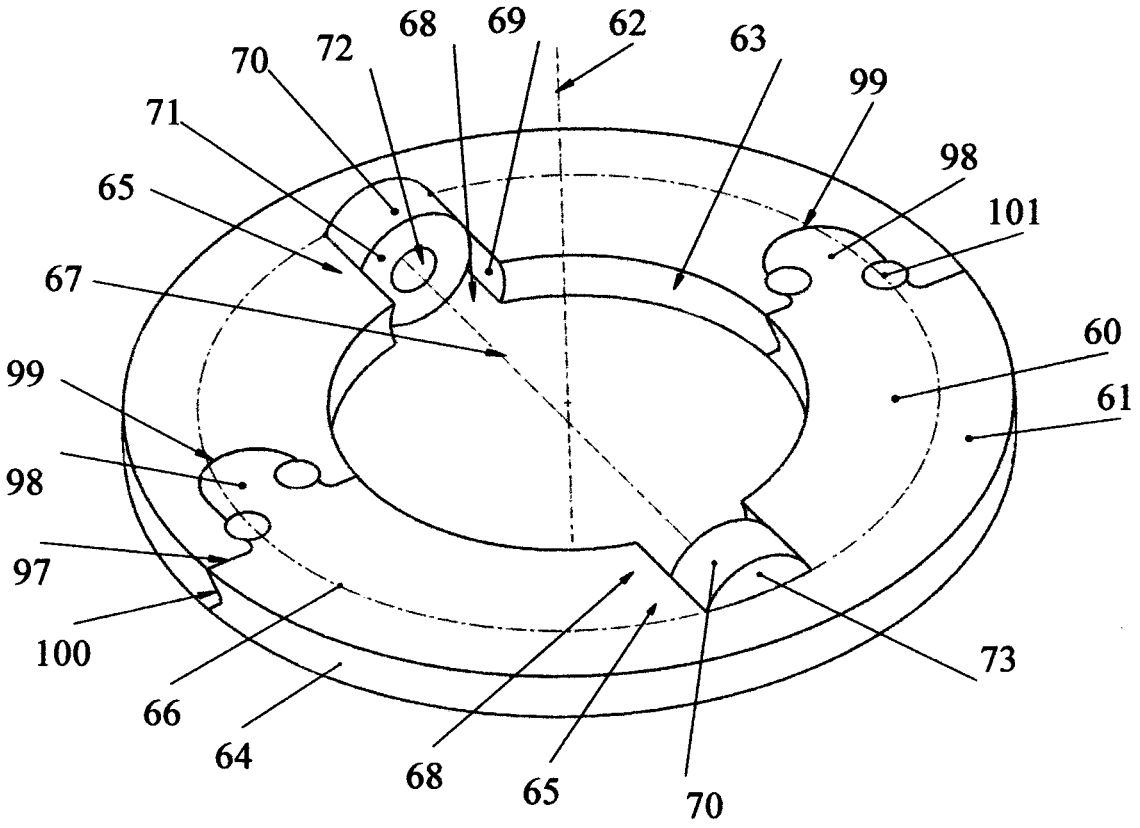
FIG. 7 shows a separator.
Figure 15:
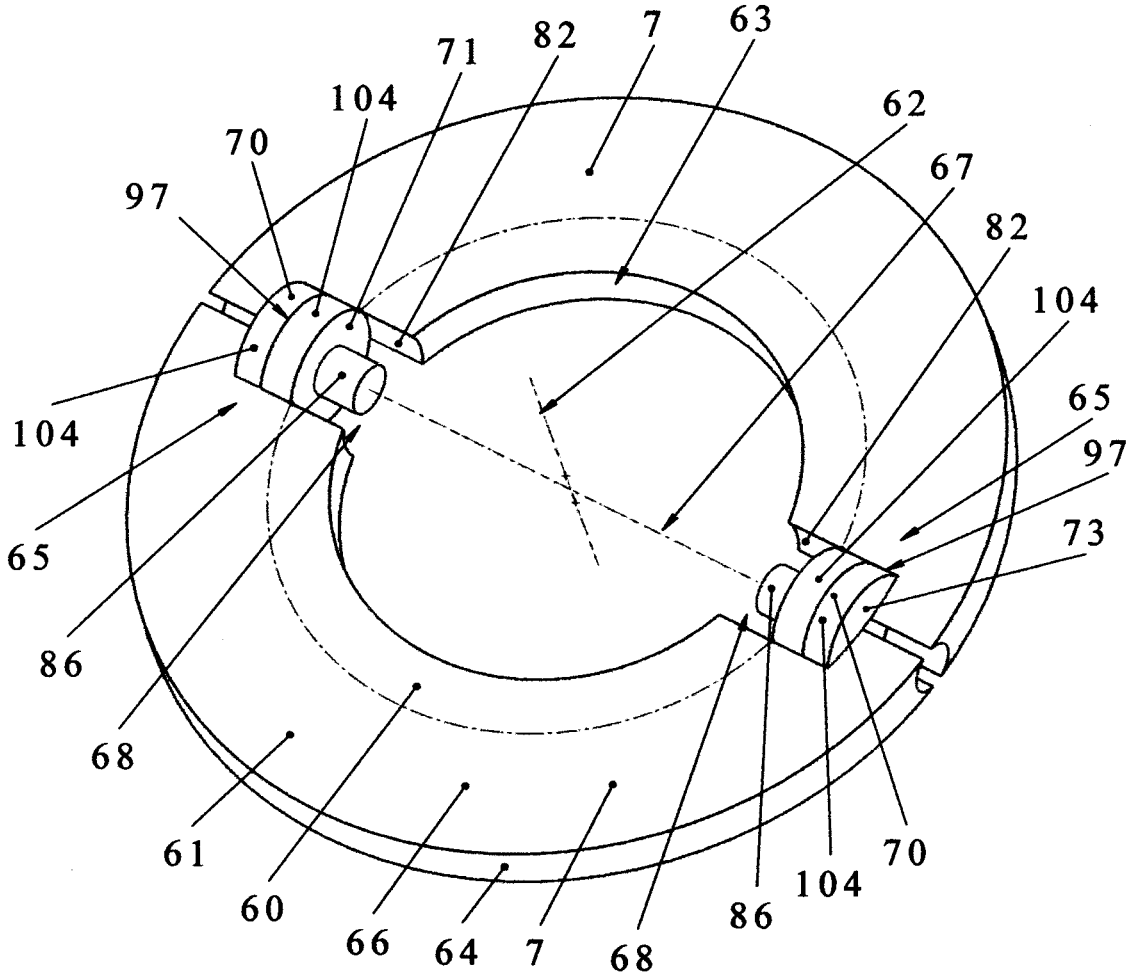
FIG. 15 shows a separator with a mate joint between its two "C"-shaped parts, the joint coincide with its hinge joint.

For assembly simplification the joint 97 between the parts of the separator 7 according to FIG. 7 is passing through the hinge joint 65 (FIG. 15). The separator 7 consists of two approximately similar e-shaped parts of the ring, at the ends of each part there are cylindrical rings 104, which are he parts of the thickenings 70 which are shared between the parts of the separator 7. On one c-shaped part of the separator 7 fall the distant from its center parts of the thickenings 70 and on the other c-shaped part the nearest to the center parts of the thickenings 70. The plane which separates them is parallel to the end faces 71.

Figure 16:
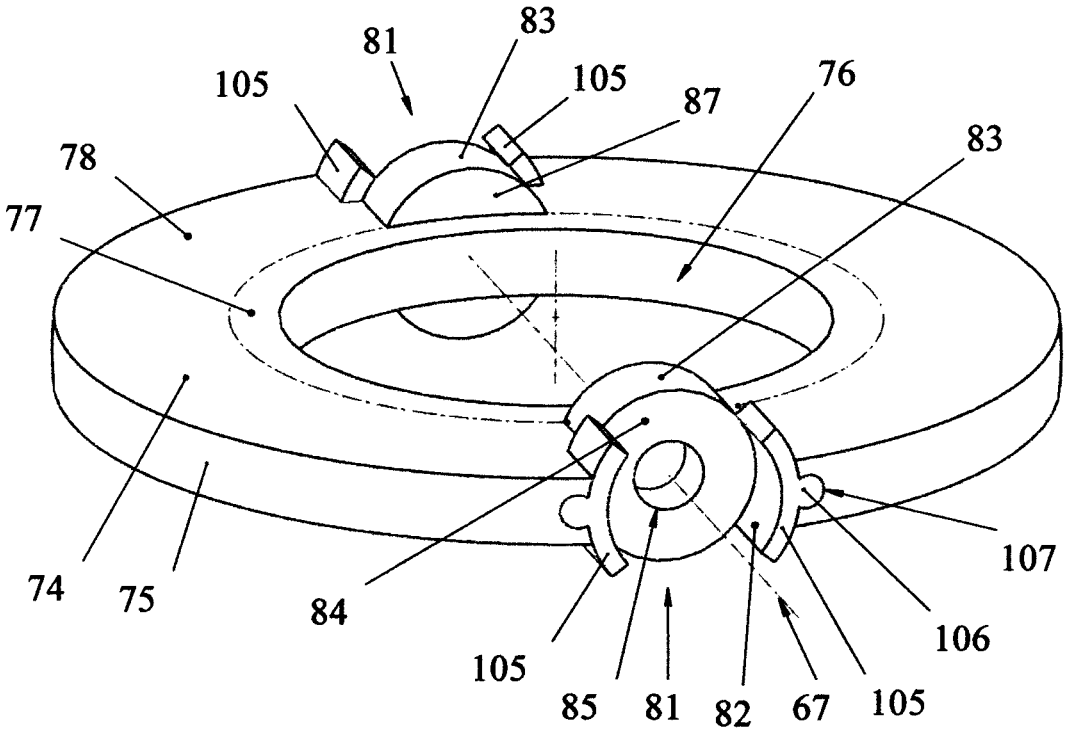
FIG. 16 shows a piston with inserts.

Thereby for assembly simplification and increasing of bearing surface the cylindrical areas 82 on the piston 6 (FIG. 16) are made on the inserts 105 and increased in angular dimensions. The sectional view of the insert 105 is a combination of a circle sector with a small circle which is positioned symmetrically from outer side of the circle sector. I.e. the insert 105 is shaping as an arc with the coaxial to it cylindrical bulge 106 from the outer side.

For the inserts 105 on the piston 6 similar slots 81 will be made but of slightly larger size, on which cylindrical areas 82 the coaxial to them cylindrical grooves 107 are made for the cylindrical bulge 106.

During assembly the piston 6 is placing into the rotor 4 at first and then the c-shaped parts of the separator 7 are joining around it, the axis 86 is placed into the holes 72 of the rings 104, the axis connecting them and after that the inserts 105 are place. Besides the axis 86 passing two rings 104 and the hole 85 of the piston 6 is pressing-in only into one of the rings 104 (preferable the second one) or only into the hole 85 of the piston 6. The other ring 104 can rotate on the axle 86. A movable jointing of the two parts of the separator 7 decreasing the load on it in the most vulnerable place—in the place of the joint position. The axis 86 takes up the centrifugal forces acting on the parts of the separator 7 in order for they do not act upon the friction pairs. The PDRM do not loose the operability also by wearing process or absence of the axis 86. I.e. for manufacturing simplification the parts of the separator 7 can be not secured to each other and the joint 97 between them can be made otherwise.

For increasing of bearing area of the cylindrical areas 69 of the separator 7 the inserts can not be used which are similar to the inserts 105.

Figure 17:
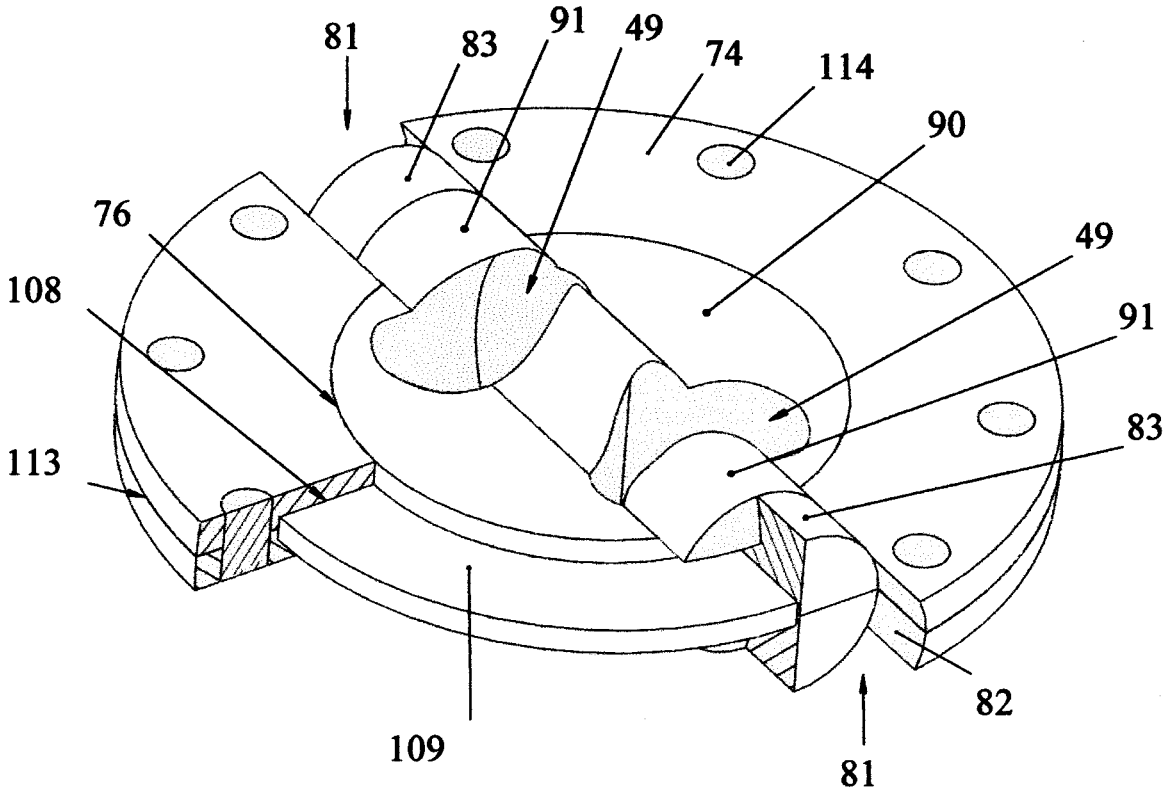
FIG. 17 shows a piston having movable and static parts. ¼ cut off is made in the movable part.

It is possible to decrease the forces acting from the working fluid on the piston 6 and on the separator 7 and also to increase their bearing surface by the separation of the piston 6/separator 7 in two parts movable relatively to each another. The ring groove 108 is made on the surface of the hole 76 in the piston 6 (FIG. 17), the groove 108 along the diameter do not cross the slots 81 of the piston 6. From the insert 90 side the ring bulge 109 made on it enters the groove. Since the bulge 109 can extend into the working cavity 150 it can take up a part of the load acting on the piston 6 including the torque and energy which are transferring between the rotor 4 and working fluid. That is why from functional point of view the bulge 109 is an immobile part of the piston 6 fixed to the rotor 4. The presence of the groove 43 on the ball-shaped part 39 of the rotor 4 is not obligatory also in other modifications of the piston 6 but the presence of the bulge 109 additionally decreases the need in it.

Figure 18:
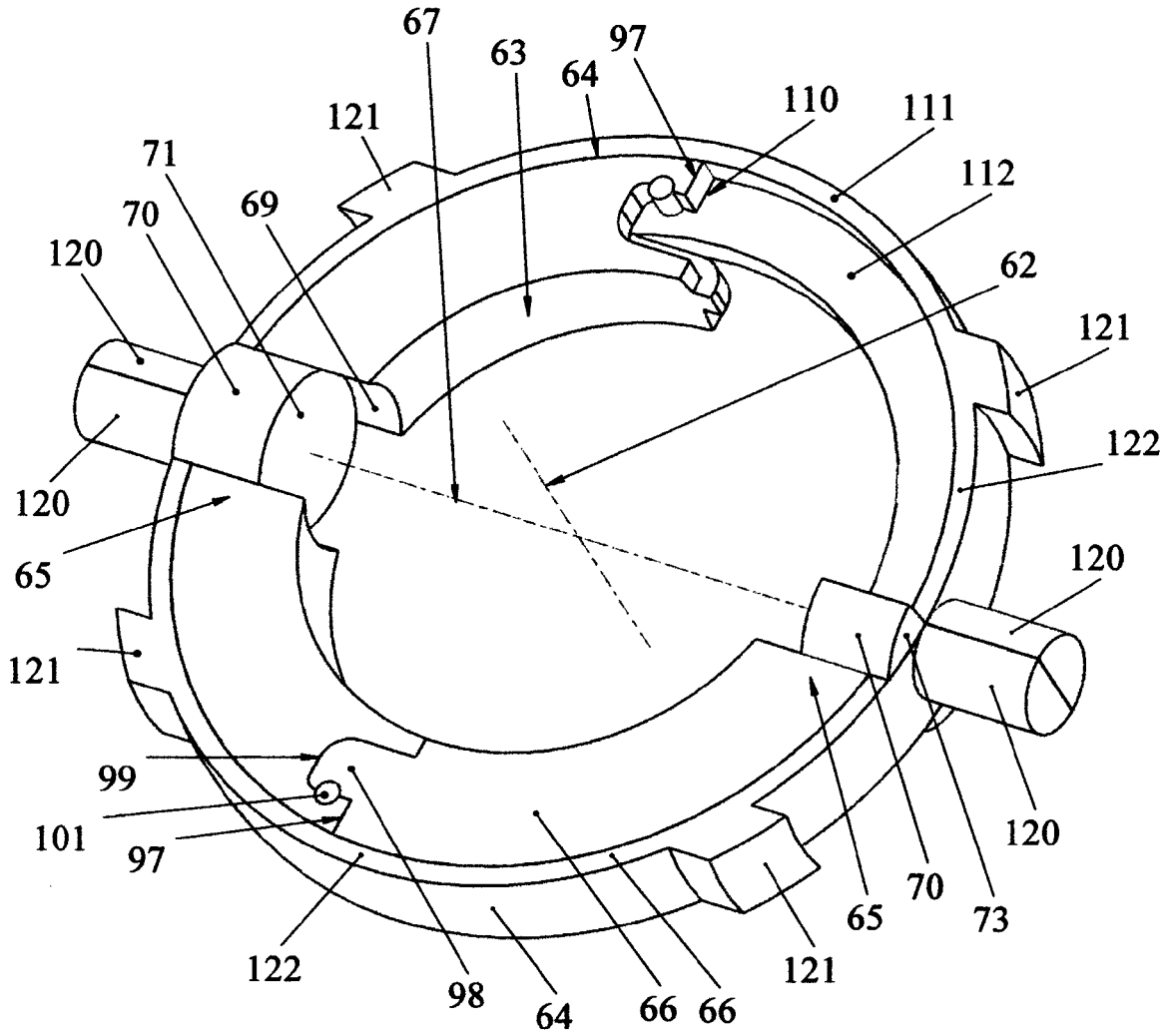
FIG. 18 shows a separator having movable and static parts. ¼ cut off is made in the movable part.

Similarly on the separator 7 (FIG. 18) the ring groove 110 can be made on the outer side face 64 that does not cross the slots 68 of the separator 7. To the housing 3 is fastened a ring 111 with the ring bulge 112 on the inner surface. The bulge 112 extending into the working cavity 150 is positioned in the groove 110 of the separator 7 and can take up a part of the load of the separator 7. That is why from functional point of view the bulge 112 and the ring 111 are a static part of the separator 7 fixed to the housing 3. Thereby the groove 15 on the housing 3 can be absent. I.e. the static part of the separator 7 can be fastened to the housing 3 with the assistance of the groove 15 or without it. Since the bulge 112 is located in the groove 110 of the separator 7 then the load by pressure difference is transferring on it to due to flows of the working fluid between end faces of the groove 110 and the bulge 112 or through the lubricant grooves (they are shown). For increasing of the proportion that is taking up the load by the static part of the separator 7 (i.e. for taking up the load from the rotating part of the separator 7) the holes which are leading into the groove 110 can be made at the end faces 66 of the movable part of the separator 7.

For possibility of assembly of the piston 6 (FIG. 17) with the ring groove 108 and insert 90 with the ring bulge 109 the piston 6 is made from two symmetrical parts. The boundary into 113 is passing along the plane of the piston 6 through its center. The parts are fixed to each other with the assistance of the rivets 114 or any other method.

The manufacturing of the separator 7 consisting of the movable relative to each other parts simplifies the creating of a PDRM with regulated feed on the basis of the PDRM according to FIG. 1. For that the static (i.e. not involved in the rotation of the rotor but having possibility to change its position relative to the housing 3) part of the separator 7 (FIG. 19) is provided with the turnable shaft 115. To increase the rigidity of the separator 7 the turnable shaft 115 (FIG. 20) is made as a cylinder 116 with a concave sphere-like head 117. The diameter of the concave surface coincides with the diameter of the cavity 11. At the center of the head 117 there is a blind hole 118 coaxial to the cylinder 116. Symmetrically closer to the ends of the heed 117 there are the grooves 119 for fastening of the static part of the separator 7. On the static part of the separator 7 there are the cylindrical bulges 120 (FIG. 19) in two its diametrically opposite places extending in radial direction. At a distance from the cylindrical bulges 120 there are fixing bulges 121 entering the grooves 119. For possibility of assembly the static part of the separator 7 is made from two half-rings 122, the joint between which is passing through the cylindrical 120.

In the housing 3 (FIG. 21) instead of the groove 15 the recesses 123 are made for the heads 117 and holes 124 for outlet of the cylinder 116 of the turnable shaft 115. The axis 125 of the holes 124 is passing through the center of the cavity 11 perpendicular to the mating plane 10.

During assembly the half-rings 122 enter into the groove 110 of the separator 7, their cylindrical bulge 120 is pressing-in into the hole 118 of the turnable shaft 115, ties them up together, and the fixing bulges 121 enter into the grooves 119 of the head. Further the turnable shafts 115 enter the holes 124 when the rotor 4 enters the housing 3.

Figure 5:
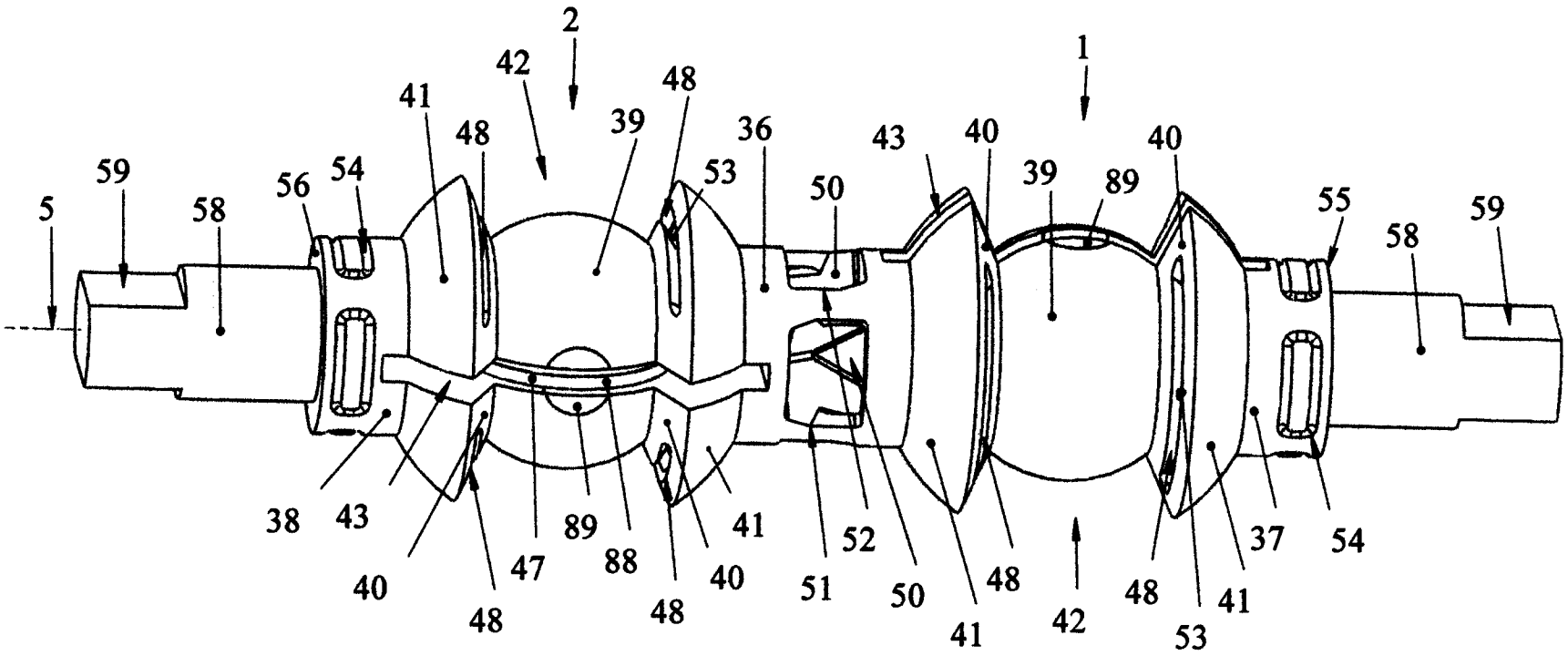
FIG. 5 shows the rotor of the PDRM.
Figure 6:
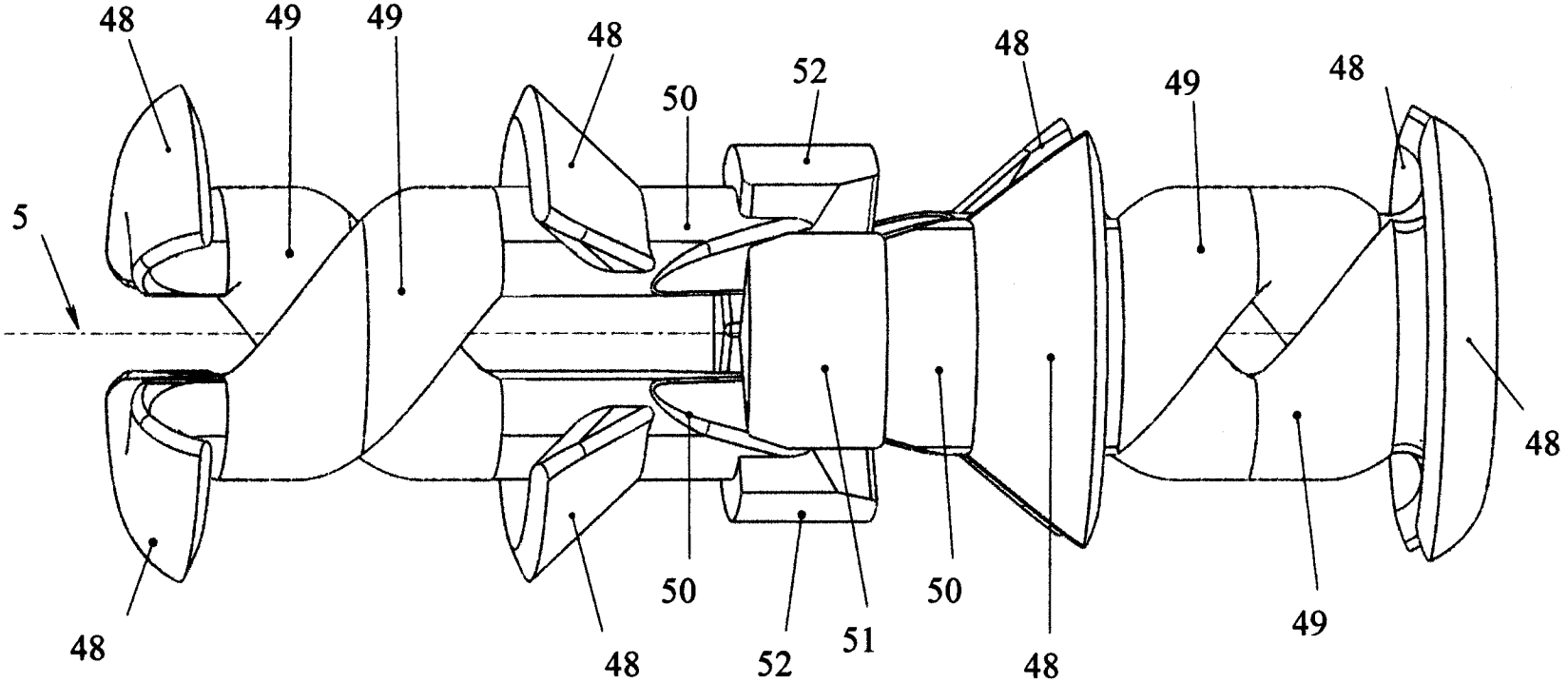
FIG. 6 shows a system of ducts inside the rotor of PDRM.

The rotor 4 of the machine does not differ principally from the rotor 4 according to FIG. 5.

Figure 22:
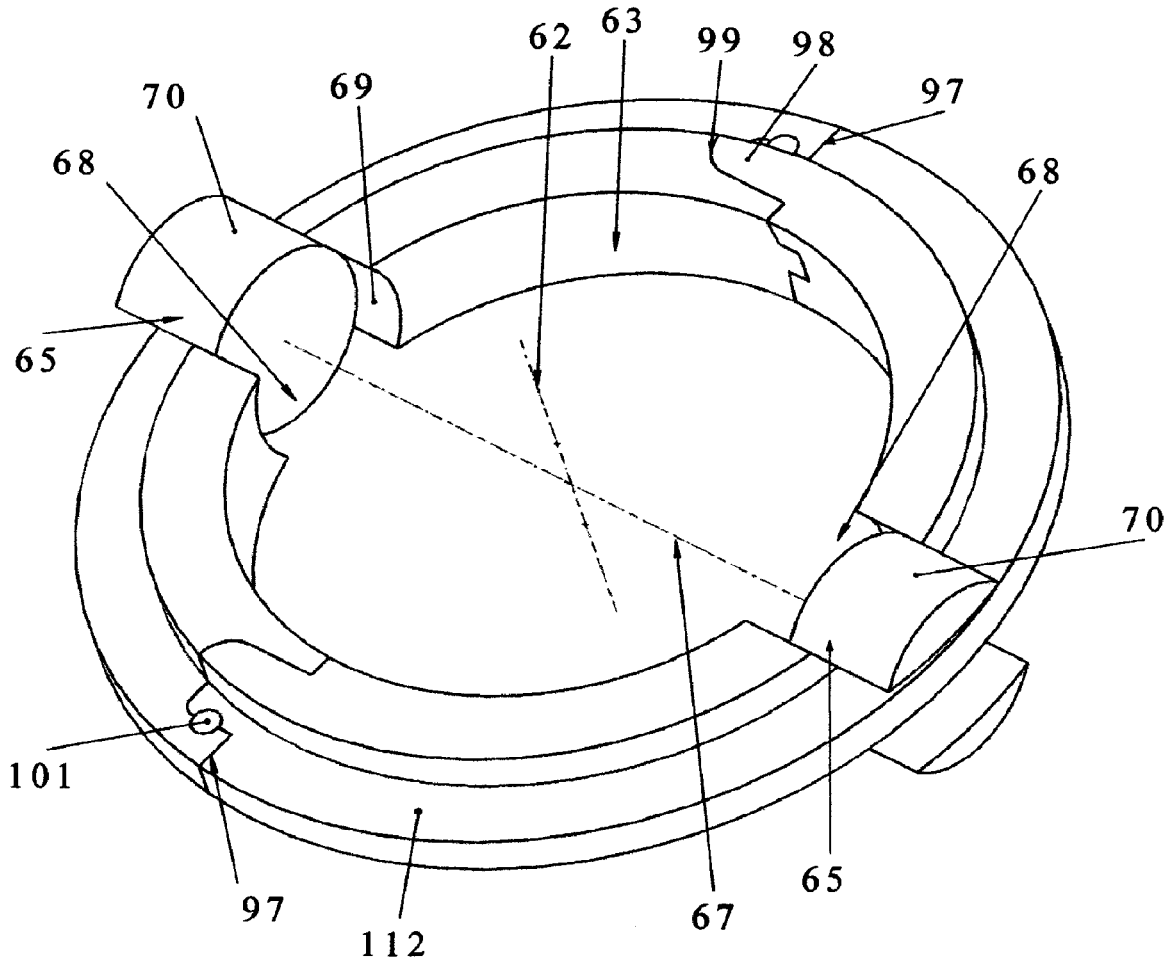
FIG. 22 shows a movable part of the separator with a protrusion for connection with the movable part of the separator.
Figure 23:
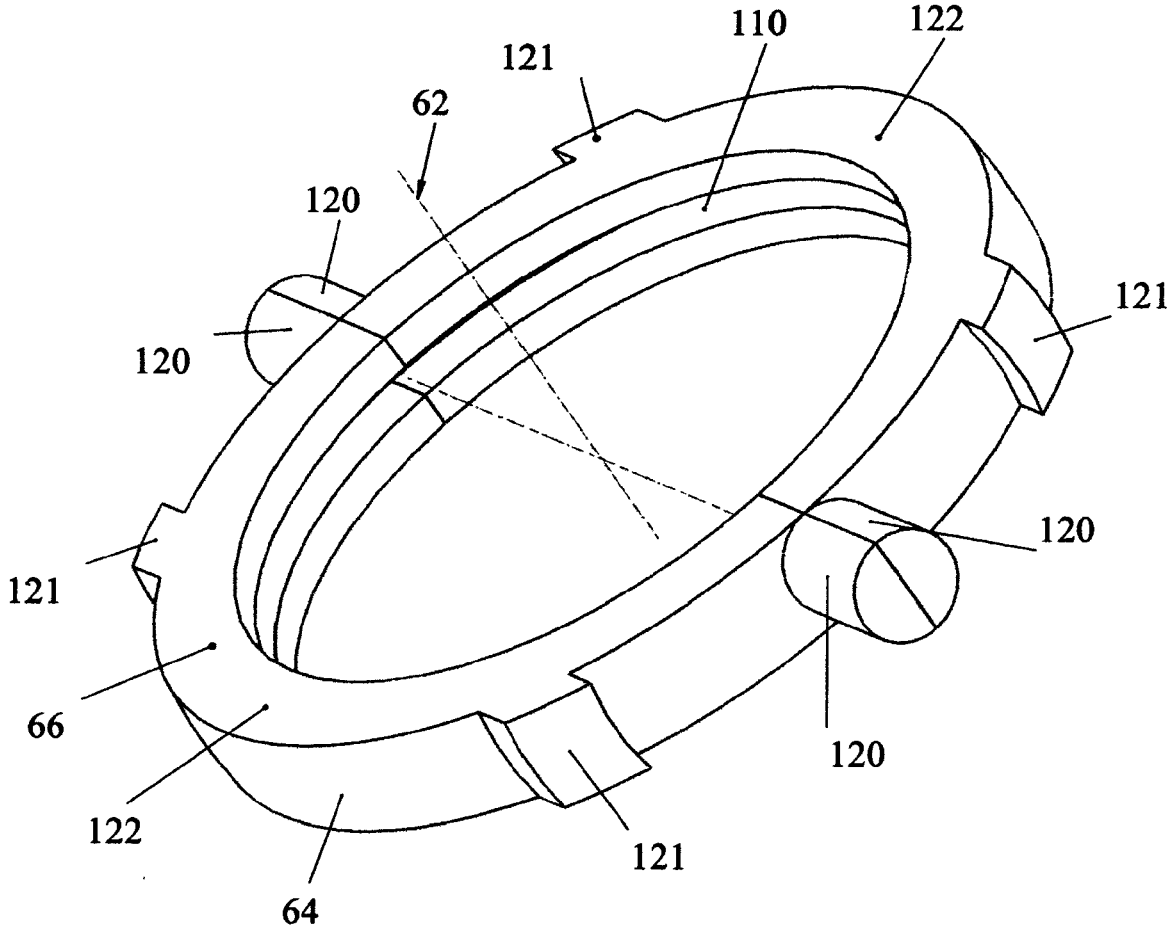
FIG. 23 shows the static part of the separator with a slot for connection with the movable part of the separator.

It is possible to increase the rigidity of the static part of the separator 7 if the positions of the bulge 112 and groove 110 will be interchanged. I.e. the bulge 112 is made on the movable part of the separator 7 (FIG. 22) and the groove 110 is done on the static part of the separator 7 (FIG. 23). Thereby the fixing area of the thickening 70 to the separator 7 is constrainedly decreasing and its cylindrical areas are extending from the main body of the separator 7.

It is possible to increase the bearing area of the separator 7 and/or piston 6 using several parallel bulges 112 and grooves 110 on their movable parts and several bulges 112/109 and grooves 110/108 on their static parts. This is a combination of the previously given examples.

Instead of the engagement of the type the bulge—groove between the rotor 4 or static part of the rotor 6 and movable part of the piston and/or between the movable and static part of the separator 7 or the housing 3 the ball bearing can be applied. To do this it is enough to make grooves, which serve as pats of the ball bearing on the corresponding parts and place between them balls with a separator.

The other design of the joint 89 also has high-reliability. the piston 6 (FIG. 24) is made as a flat ring. The end faces 74 of the ring are flat, the outer side 75 is limited by sphere-like surface with the diameter which is close to the diameter of the cavity 11 for the possibility to rotate in the cavity without large gaps. The surface of the hole 76 is cylindrical. the piston 6 can be conventionally divide in the inner (the nearest to the axis of the ring) part 77 and outer (periphery) part 78. The inner part 77 does not extend from the groove 43. On the outer part 78 the two coaxial hinge joints 127 are made central symmetrically. The joint 127 is made as a local arc-shaped bent 128 of the piston 6 which axis 80 is passing through the center of the piston 6. The bent 128 is passing completely through the outer part 7 of the piston 6. There is a sector of the ring on the local sectional view of the bent 128. In the present example its (ring sector) angle dimensions are: 250 degrees per inner bent and 130 degrees per outer bent.

The separator 7 (FIG. 25) has the form of a body of revolution—symmetrical ring. Conventionally one can mark on it (ring) the inner (the nearest to its center, axis) part 60 and other (i.e. farther from its center) part 61. On the figure they are separated by line-and-dash circle. The outer part 61 in the assembled PDRM is located in the groove 15 and the inner part 60 is located in the cavity 11. The axis 62 is the ring generatrix axis of revolution. The central hole 63 in the ring is limited by the sphere-like surface having the diameter close to the diameter of the ball-shaped part 39 of the rotor 4 in order to be able to mount the separator 7 on it with minimal gap allowing their relative rotation. The outer side face 64 of the ring is limited by the sphere-like surface that is concentric to the central hole 63 which diameter is close to the diameter of the sphere-like surface 16 of the groove 15. The end faces 66 of the separator 7 are flat. The outer part 61 serves for interaction with the groove 15 of the housing 3, and on the inner part 60 central symmetrically two coaxial hinge joints 129 are made. The hinge joint 129 is made as the through arc-shaped slot 130, which axis 67 is passing through the center of the separator 7. The slot 130 is passing from the hole 63 till outer part 61. The slot 130 is limited from side by the concave cylindrical area 69 that is similar to the area 69 of the separator 7 according to FIG. 7, from the other side by sector (part) of the cylinder 131 with angle dimension example of 300 degrees.

The sector diameter of the cylinder 131 can be not only smaller or equal but also can be larger than the thickness of the separator 7. I.e. in this place can be a thickening of the separator 7.

The friction pair is the concave cylindrical area 69—the outer side of the bent 128 of the piston 6 is similar to the friction pair the area 69—thickening 70. Therefore for increasing of bearing area on the place of the areas 69 the inserts 105 can he used.

In other embodiment one or both bents 128 can be made on the separator 7 and one or two slots 130 on the piston 6.

Figure 27:
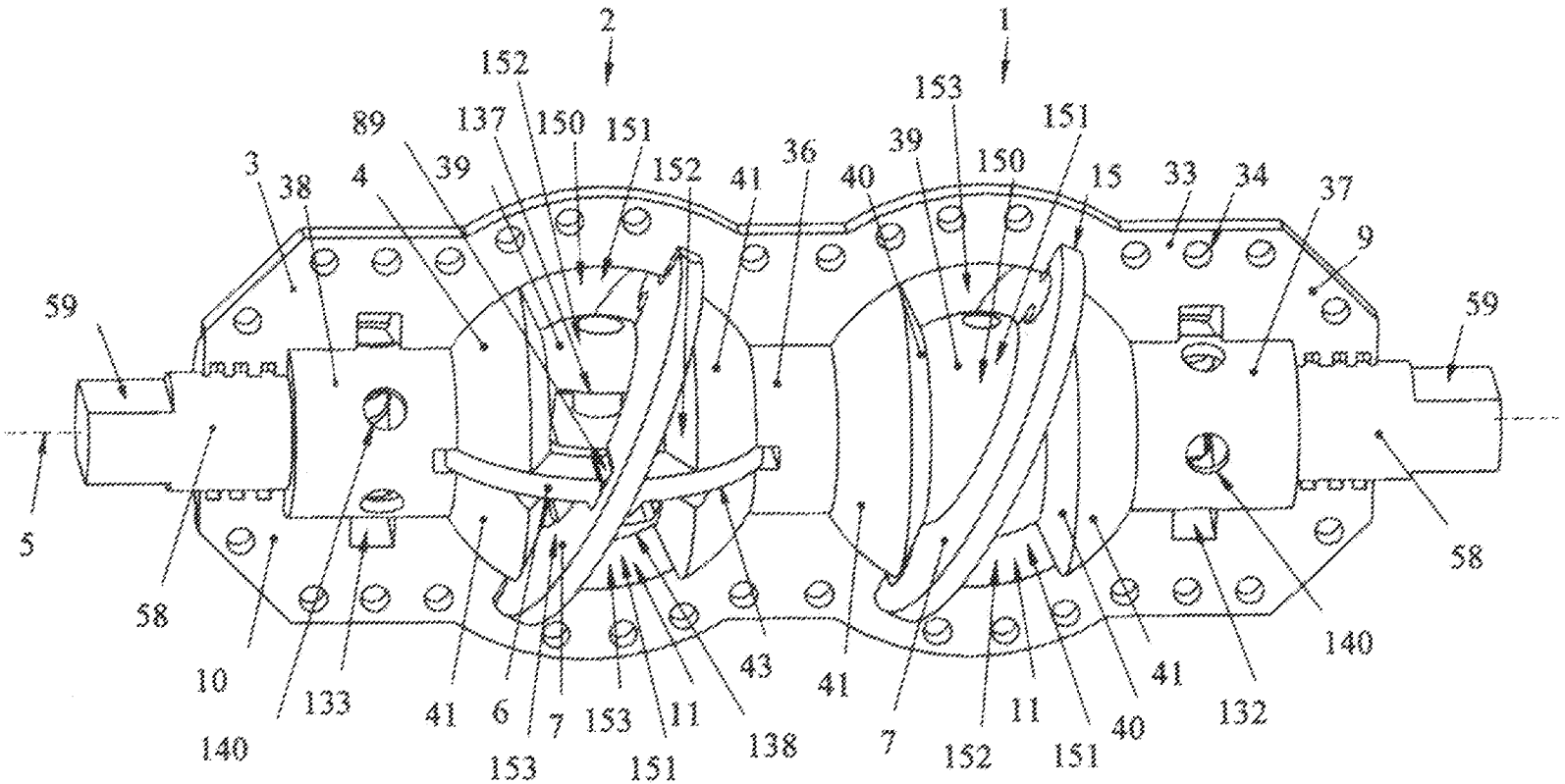
FIG. 27 shows the PDRM with the flow of working fluid along the rotor trough ducts made inside the rotor.

The hinge joints 79/65 on the piston 6 and/or on the separator 7 can be used by other embodiments of the PDRM with the sphere-like working cavity 11 increasing their reliability. For example, it can be used in the PDRM with the passage of the working fluid through the rotor 4 along the axis 5 of the rotor 4 (FIG. 27). In this example two stages 1 and 2 were used to show how the stages mate each other. On their position can be any quantity of stages.

Figure 28:
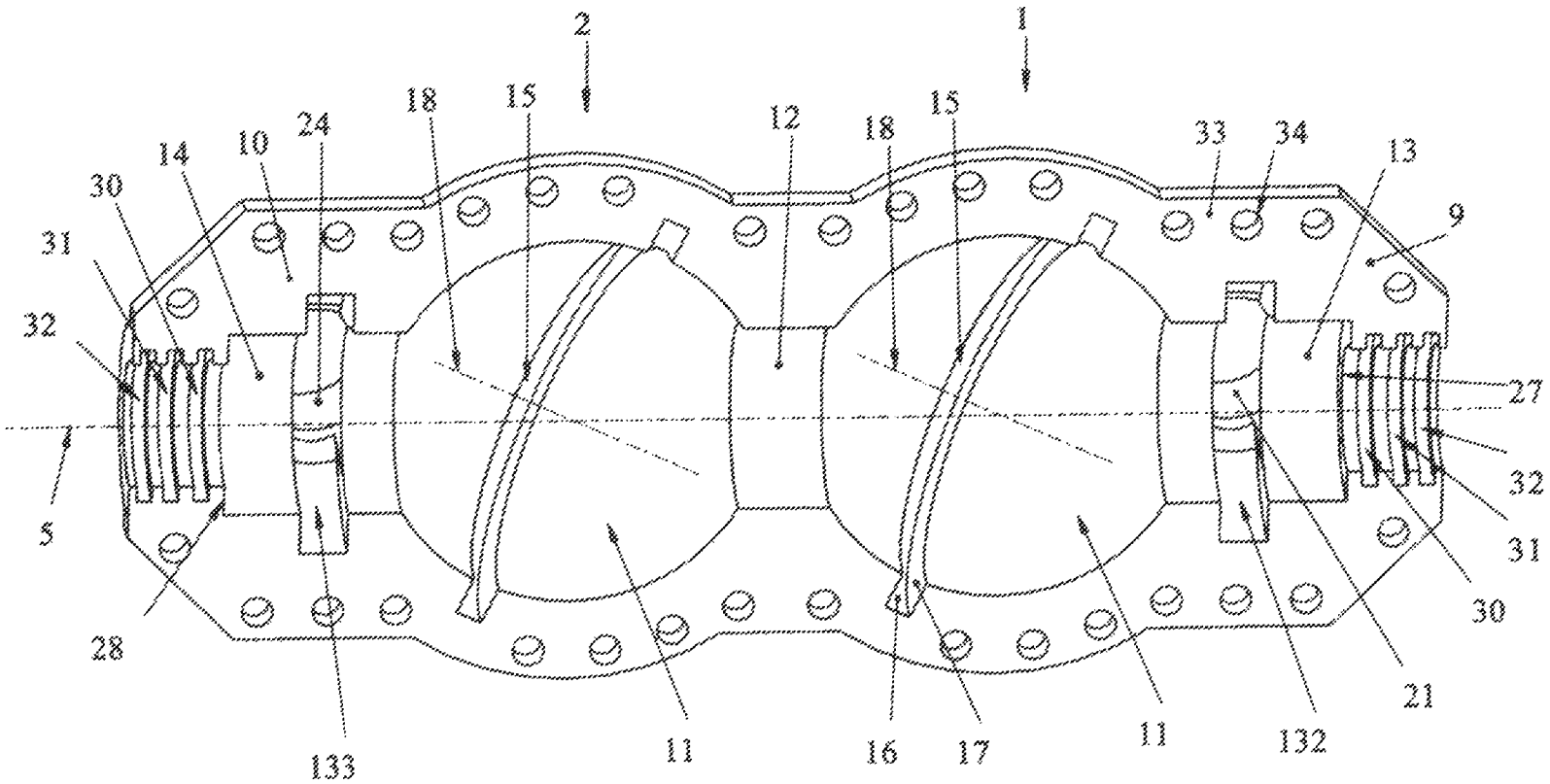
FIG. 28 shows a housing part of the PDRM according to FIG. 27.
Figure 29:
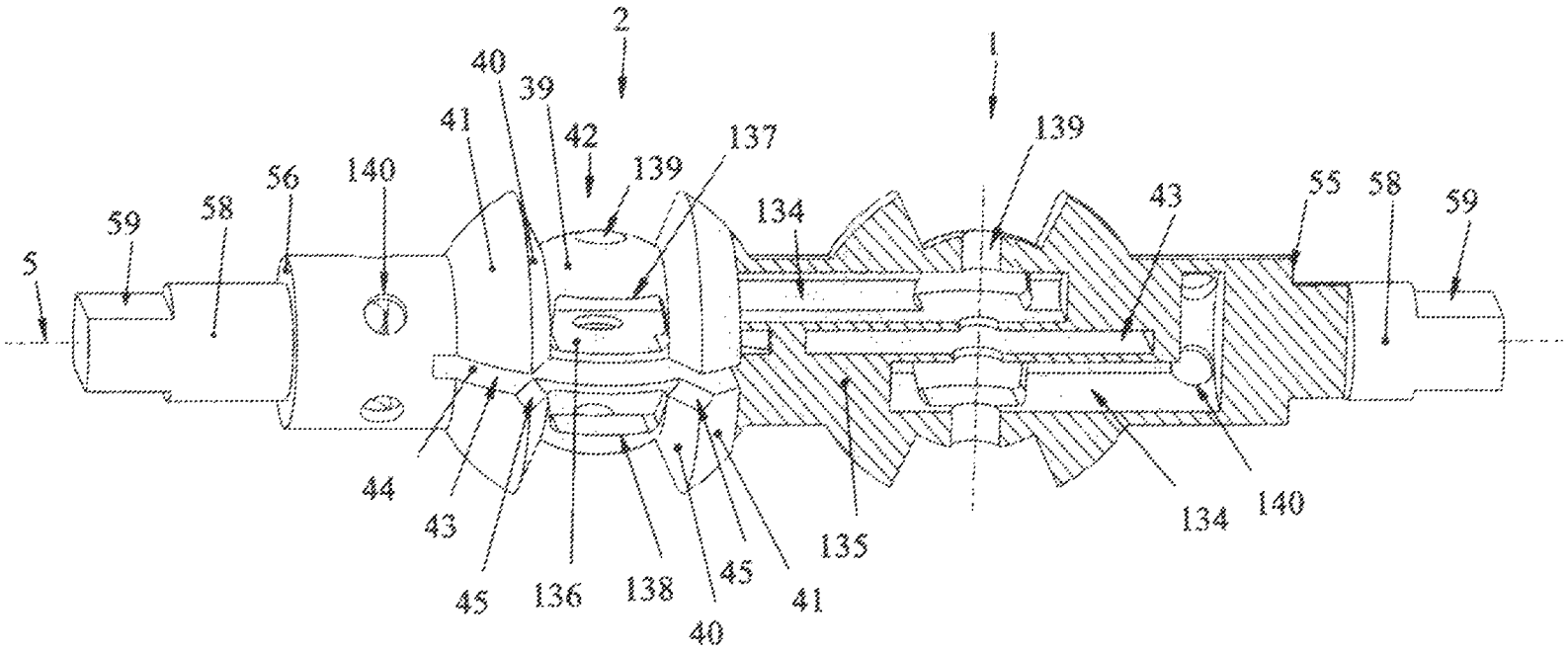
FIG. 29 shows the rotor of the PDRM according to FIG. 27 with ½ cut off of one of the stages.

The housing 3 (FIG. 28) of the PDRM is similar in many details to the housing of the PDRM according to FIG. 1. There are differences in inlet and outlet of the working fluid. The housing 3 of the PDRM is made from the two practically (within the consideration of fastener elements, grooves for sealing elements and branch pipes of the inlet 21 and outlet 24 of the working fluid) mirror symmetric parts 8 and 9 (FIG. 29). The part 8 is not shown because it is similar to the part 9. The mating plane 10 between them is passing through the axis 5 of the rotor rotation 4. There are two sphere-like cavities 11 (one per a stage) in the housing 3, which centers are laying on the axis 5. Coaxial to the axis 5 the cylindrical hole for the rotor 4 is passing through the cavities 11. The cavities 11 divide it in three areas: middle 12, being between the cavities 11 and two outer 13 and 14 extending beyond the cavities 11 to the opposite directions.

Around each sphere-like cavity 11 the ring groove 15 of lager outer diameter than the diameter of the cavity 11 is symmetrically located in it and opened into the cavity. I.e. it is made on the surface of the cavity 11. The groove 15 is limited by the sphere-like surface 16 which center coincides with the center of the cavity 11 and two end faces 17 in the form of the symmetrically located parallel flat rings. The axis of symmetry 18 (the groove 15 generatrix revolution axis) of the groove 15 is located in this example at the angle 25 degrees to the axis 5 and is laying in the mating plane 10.

On the outer area 13 of the cylindrical hole, on the housing 3 there is a ring groove 132 for inlet to the rotor of the working fluid. At the one part 9 there is a branch pipe 21 of the inlet of the working fluid leading to the groove 132. There is a thread tor connection of supply main pipes at the end of the branch pipe 21. Analogous, at the outer area 14 of the cylindrical hole, on the housing there is a ring groove 113 for outlet of the working fluid from the rotor 4. On the same part 9 there is the branch pipe 24 of outlet of the working fluid leading to the groove 133. There is a thread for connection of supply main pipes at the end of the branch pipe 24. The end faces 27 and 28 of the sections 13 and 14 correspondingly serve as axial bearings in order to limit the motion of the rotor in the axle direction.

On the end faces 27, 28 from the cylindrical section 13 there are coaxial to the axis 5 outlet holes 29 of smaller diameter. At the mating perimeter of the housing 3 on its both parts 8 and 9 there is a flange 33 for their connection to each other. There are holes 34 for pin-bolts on the end face 33. On the end face 33 grooves (not shown) for sealing of the immobile mating along the perimeter of the inner cavity of the housing 3 are also made.

Stages 1 and 2 of the rotor 4 (FIG. 29) are made on one cylindrical shaft. They divide it in three sections: middle 36 and two outer 37 and 38 extending in outer directions from the stages 1 and 2. each stage of the rotor 4 has the central ball-shaped part 39 with the center on the axis 5 and with the diameter close to the diameter of the shaft. From the opposite sides along the axis 5 two side walls 40 made in the form of truncated cone which are coaxial to the axis 5 and symmetrically rested with the smaller base stands on the bal-shaped part 39 are located. The side walls 40 are connected with the sections 36 and 37 on the stage 1 and sections 36 and 38 on the stage 2 by the transitions 41 having sphere-like surfaces which diameter larger than the diameter of the shaft and the centers coincide with the centers of the corresponding central ball-shaped parts 39. Between the two side walls 40 of each stage the opened outward ring cavity 42 is formed which bottom is the surface of the ball-shaped part 39. From one side of the rotor 4 along the axis 5 the groove 43 for the piston 6 is passing through the side walls 40, transitions 41 and ball-shaped part 39. The groove 43 is getting in the ball-shaped part 39 deeper then its center. For convenience of manufacturing the grooves 43 are touching the sections 36, 37, 38. The end face surfaces 44 of the groove 43 are flat and parallel to the axis 5. At places of the groove 43 outlets to the side walk 40 there are the hollows 45 on the surface of the wall 40 from one side of the 43. The duct 42 crosses the groove 43 in one place.

Two straight ducts 134 for passage of the working fluid are made through all stages inside the rotor 4. Their sectional views have a form of circle section (a little bit smaller than a half) cut off be chord. Its corners are rounded. The stubs 135 are left at the beginning of the duct 134, between all stages 1, 2 and at the end of the duct 134, interchangeability in the ducts 134. I.e. in one duct 134 is the partition 135 left before the first stage 1, in the second duct before the second stage 2 and etc. After the last stage in the next duct 134 the stubs 135 is also installed. The groove 43 is passing on the wall 136 dividing the ducts 134.

From one side of the groove 43 on the surface of the ball-shaped pat 39 the inlet opening 137 for the working fluid is made leading to the duct 134 and not divided by the stubs 135 before this stage. The opening is similar to an equilateral trapezium with rounded corners (on the sphere) oriented by the larger base to the groove 43 and is bordering to it. From the other side of the groove 43 through the surface of the ball-shaped part 39 the outlet opening 138 is made leading to the other duct 134 divided by the stub 135 at the entrance of the stage. Since each next stage of the rotor 4 is turned relatively to the previous stage around the axis 5 half-around so one duct 134 is connecting the outlet opening 138 of the stage 1 with the inlet opening 137 of the next stage 2. In the ball-shaped part 39 and in the wall 136 there is a hole 139 which axis is passing through the center of the ball-shaped part 39 perpendicularly to the wall 136. The hole 139 serves for the mounting of the axis of the piston 6. At the outer section 13 there are the holes 140 connecting the not divided duct 134 with the groove 132. The similar holes 140 at the outer section 14 connect not divided there the duct 134 with the groove 133.

At the ends of the rotor 4 for connection with the drive and next sections of the PDRM there are output half shafts 58 of smaller diameter than the diameter of the sections 36, 37, 38.

Figure 24:
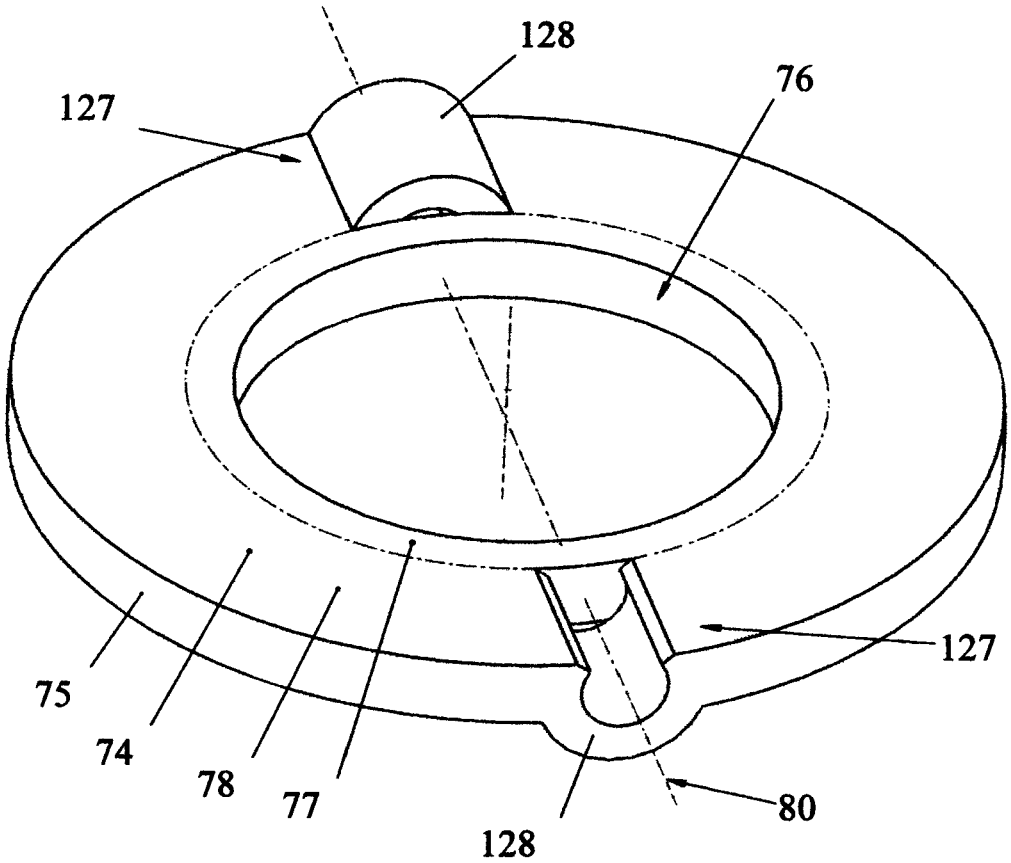
FIG. 24 shows a piston with a hinge joint in the form of an arc-shaped bent.
Figure 30:
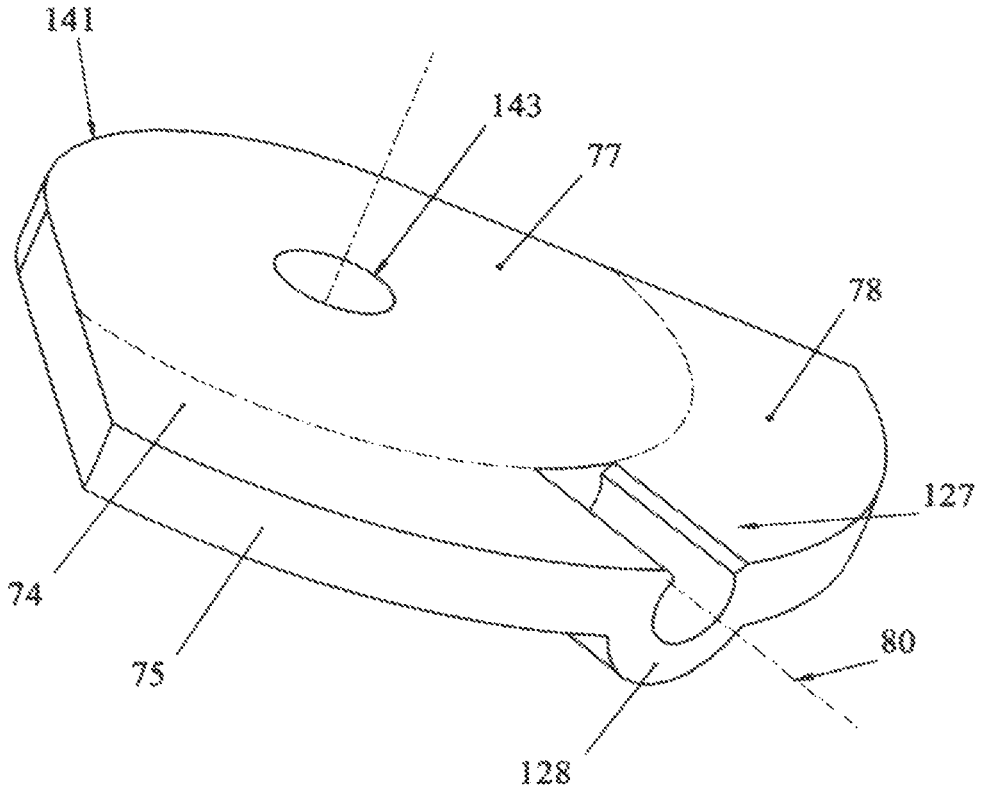
FIG. 30 shows the piston of the PDRM according to FIG. 27.

The piston 6 (FIG. 30) looks like the part of the piston 6 according to FIG. 24 with one hinge joint 79 but without the hole 76. The piston 6 is made in the form of a symmetrical part of the disk with the flat (except the hinge joint 127) end faces 74. In this embodiment, the disk part comprises the sector of 70 degrees and the cylinder with the diameter a little hit smaller than the diameter of the ball-shaped part 39. It is limited by the sphere-like side face 75 which diameter is close to the diameter of the cavity 11, concentric to it section of the cylindrical surface 141 and two flat areas connecting them. Conventionally on the piston 6 can be marked the inner part 77—the part that does not extend beyond the ball-shaped part 39 and outer part 78—farther part from the center of the end face side 75. Symmetrically through the outer part 78 of the piston 6 the hinge joint 127 is passing. It is made as local arc-shaped bent 128 of the piston 6 which axis 80 is passing through the axis of rotary oscillations of the piston 6. In local sectional view of the bent 128 there is the sector of the ring. In the present embodiment its angle dimension are: 250 degrees per inner curve and 130 degrees per outer curve. In the piston 6 there is a coaxial to the axis of the of rotary oscillations of the piston 6 hole 143 for installing an axle in it.

Figure 25:
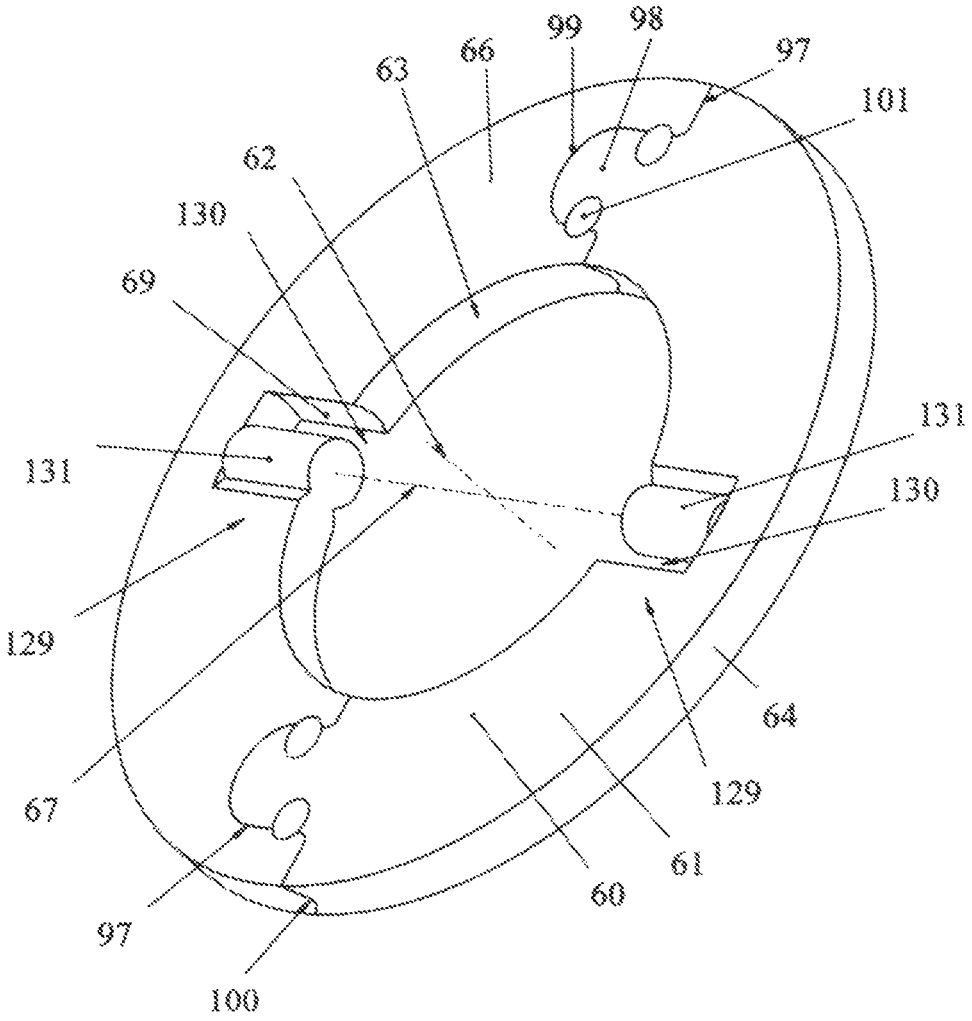
FIG. 25 shows a separator with a hinge joint in the form of an arc-shaped slot.
Figure 26:
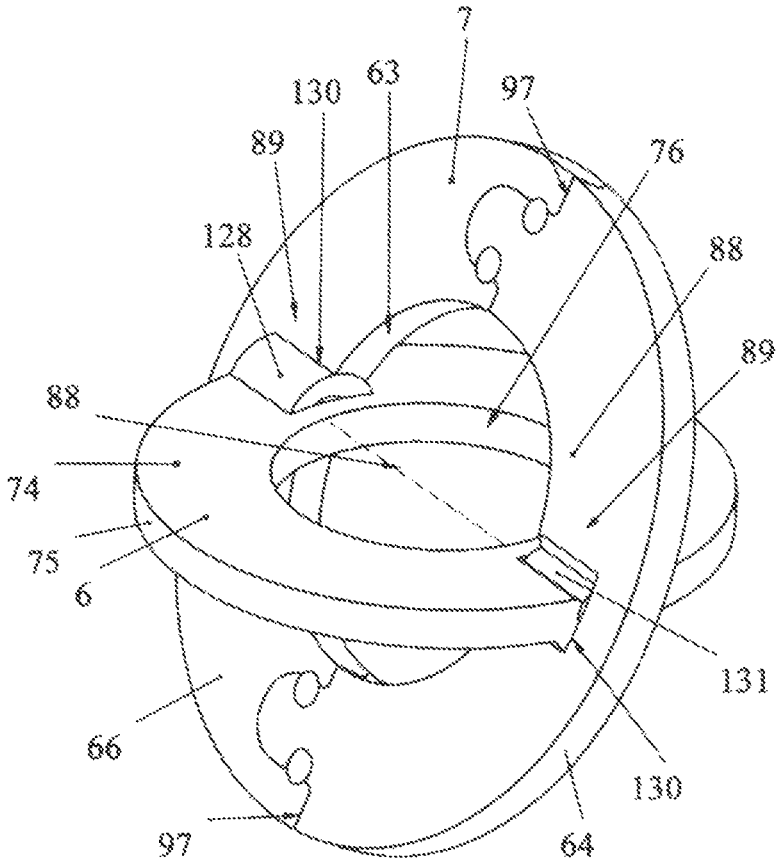
FIG. 26 shows a hinge interaction of the piston according to FIG. 24 and the separator according to FIG. 25.
Figure 31:
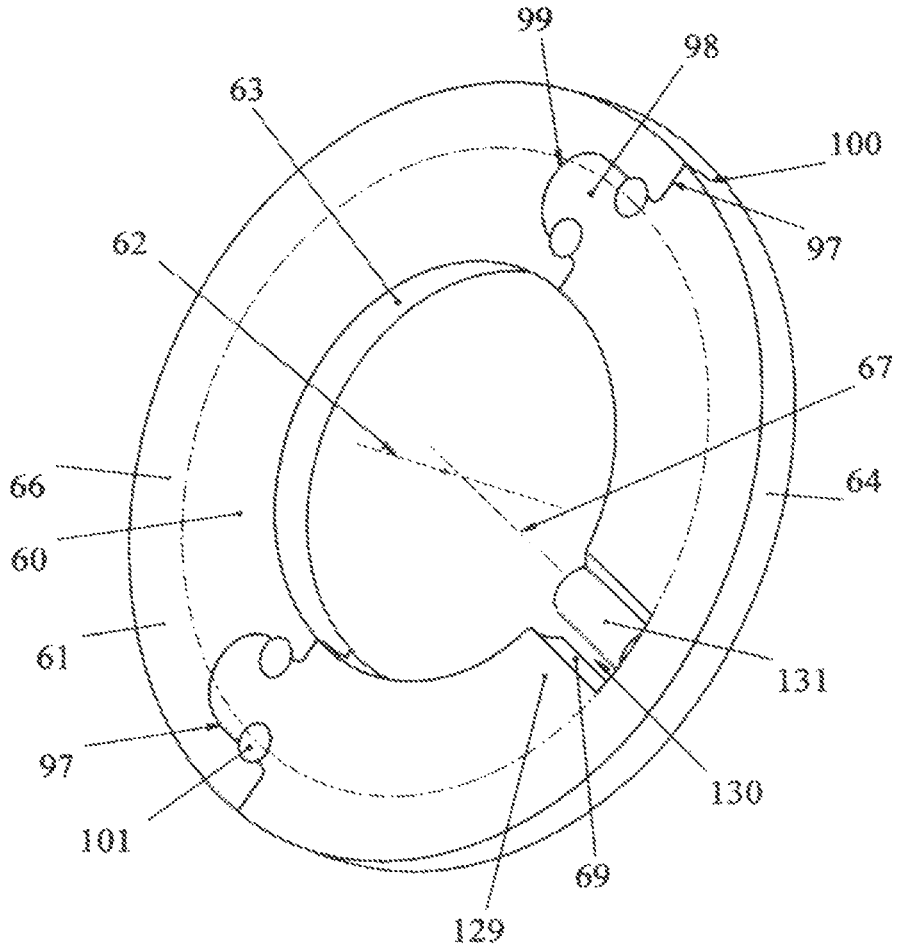
FIG. 31 shows the separator of the PDRM according to FIG. 27.

The separator 7 (FIG. 31 ) is similar to the separator 7 according to FIG. 25, except that there is only one hinge joint 129 on it.

Figure 32:
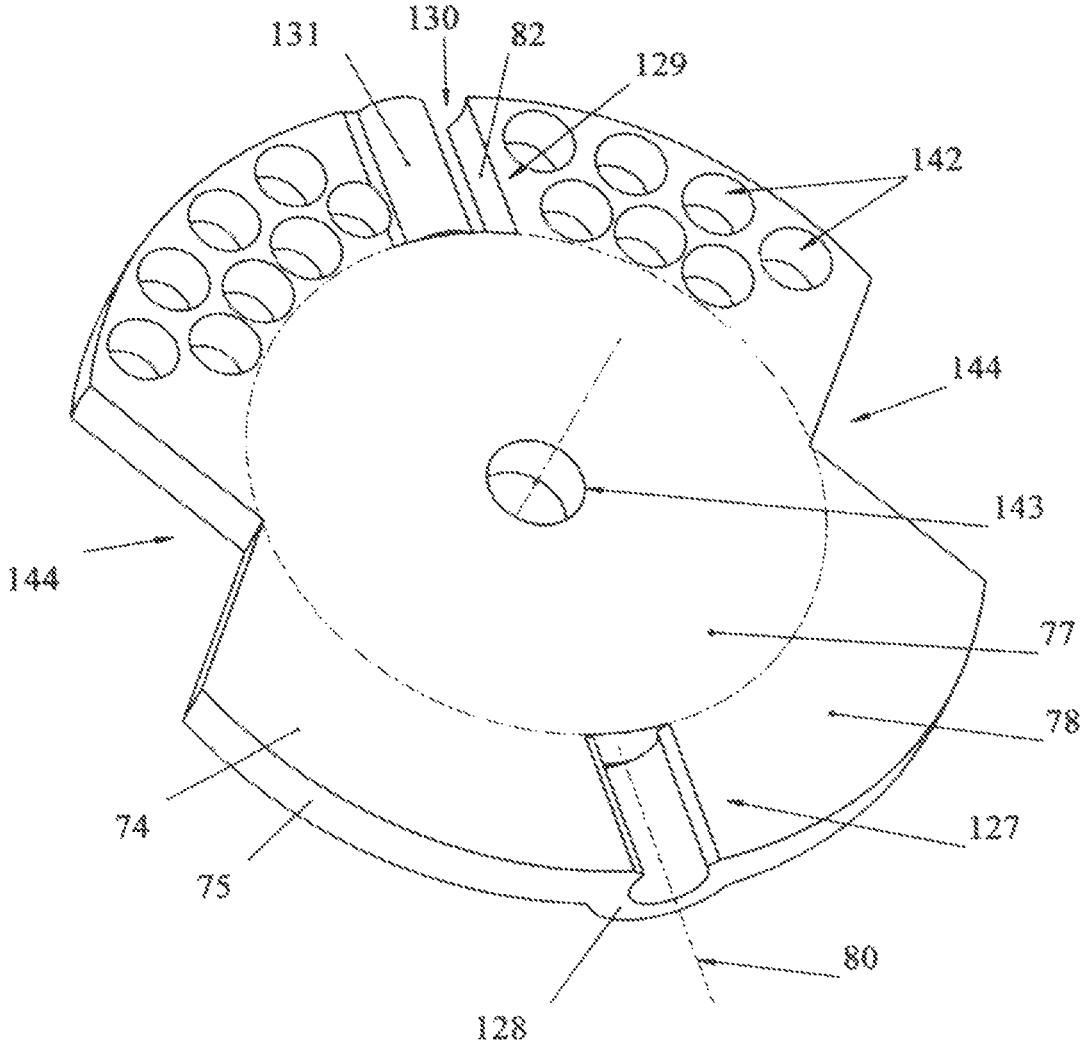
FIG. 32 shows the piston with holes and with hinge joints of different types according to FIG. 27.

For synchronization strengthening of the piston 6 and the separator 7 the piston 6 (FIG. 32) in the present PDRM can be made in the form of a whole disk as the piston 6 according to FIG. 24. For that the groove 43 is making as open-ended. It is preferably to make the second hinge joint 129 on the piston 6 for convenience of mounting into the rotor 4 as an arc-shaped slot 130 with the cylinder sector 131 and the second hinge joint 129 on the separator 7 (FIG. 33) as an arc-shaped bent 128. Such location of the hinge joints 127, 129 makes this PDRM more leak-tight i.e. pressure difference is falling on the side of the piston without holes 142 and on the opposite to it side of the separator 7 where the hinge joints 127 without slots 30 are used. The added part of the piston 6 in comparison with FIG. 30 has not to create any blocks to the working fluid during its passage through the working cavity that is why in the its extending into the working cavity part the holes 142 are made.

Figure 33:
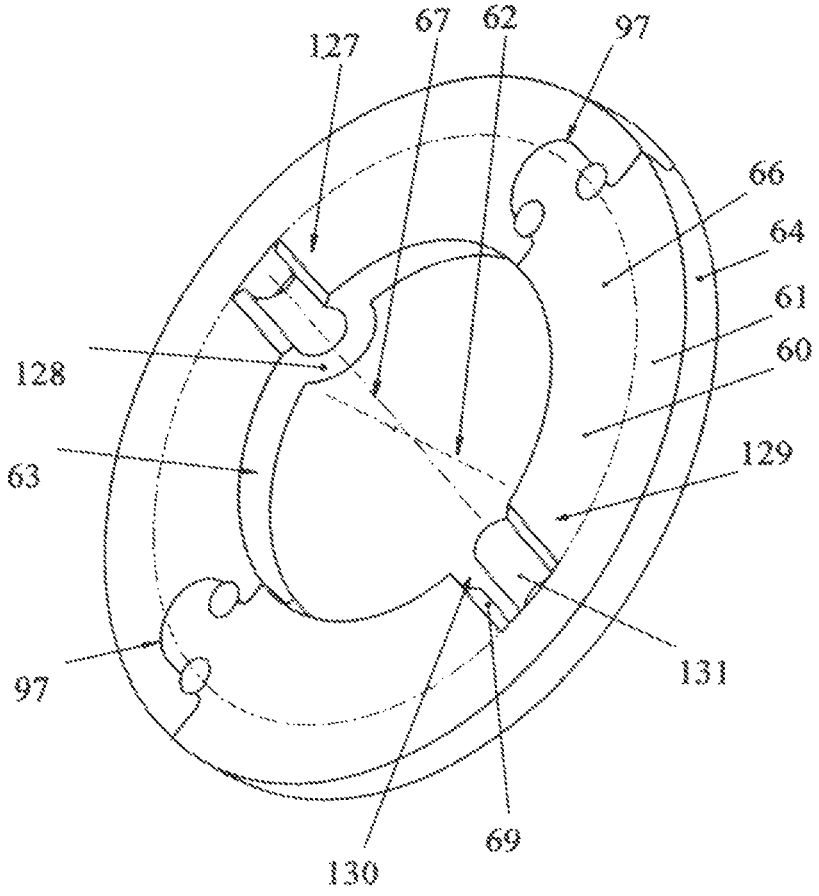
FIG. 33 shows the separator with hinge joints of different types according to FIG. 27.
Figure 37:
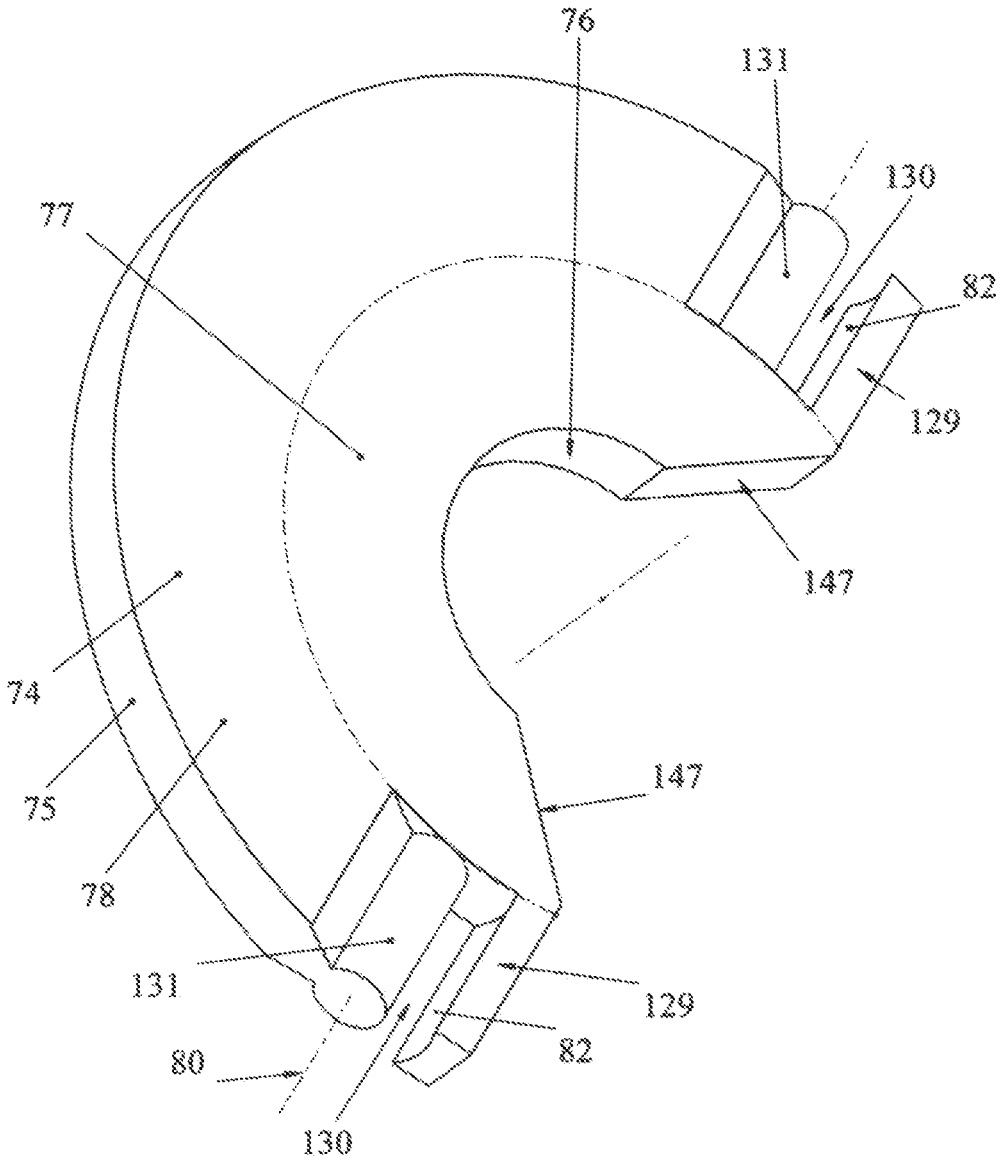
FIG. 37 shows a piston of PDRM according to FIG. 34.

In the PDRM according to FIG. 37-33 the passage of the working fluid from stage to stage is realized through the ducts 134 passing inside the rotor 4. The PDRM can consist of great number of stages.

The ducts of sufficient cross section passing inside of the rotor 4 in PDRM of such embodiment were succeeded to manufacture due to small thickness of the piston 6 which is possible when using the separator 7 at least one part which is rotating.

For unloading the rotor 4 from axial force, the stage 1, 2 of the PDRM can pump through the working fluid in opposite to each other directions. For this purpose the ducts 132 and 133 are replaced from the sections 13 and 14 to the section 12 (not shown). The branch pipes 21 and 24 can be located as on one part 8 or 9 so on the others. Thereby the leading to them duct are passing along the axis 5 to the section 12 but not to the sections 13/14.

For producing of feed which is close to uniform by one stage (in one cavity 11) in one stage several pistons 6 (FIG. 34) can be mounted. By using of one stage it is convenience to divide the housing 3 on the central symmetrical parts 8 and 9 by the planes 10 which are passing along the end faces 17 of the groove 15. Thereby there is a flange 33 at the boundary as a ring with the holes 34 for connection of the parts 8 and 9 by the pin-bolts. Thereby a spacer plate 145 is presenting as a flat ring with extension of the holes 34 between the parts 8 and 9. The side face 16 of the groove 15 is relocated to the spacer plate 145 as the surface of its hole. Within the part 8/9 there is the section 37/38 of the hole and a little bit smaller than a half of sphere-like cavity 11 which center is laying on the axis 5 of the hole. The cavity 11 is limited by the inclined to the axis 5 plane which is passing through the mating plane 10. On the surface of the cavity 11 closer to the section the hole 37/38 symmetrically to the axis 5 the inlet opening 20 and the outlet opening 23 of the working fluid are located. The angular length of the opening 20/23 around the axis 5 in this embodiment is 90 degrees. The openings 20/23 are located in the interaction area of the surface 41 of the rotor 4 with the housing 3. The inlet opening 20 is leading into the branch pipe 21 of the inlet 21 that has the thread 22 for connection of supply pipes. The outlet opening 23 is passing into the branch pipe of the outlet 24 having the thread 25 for connection of discharge pipes.

Figure 36:
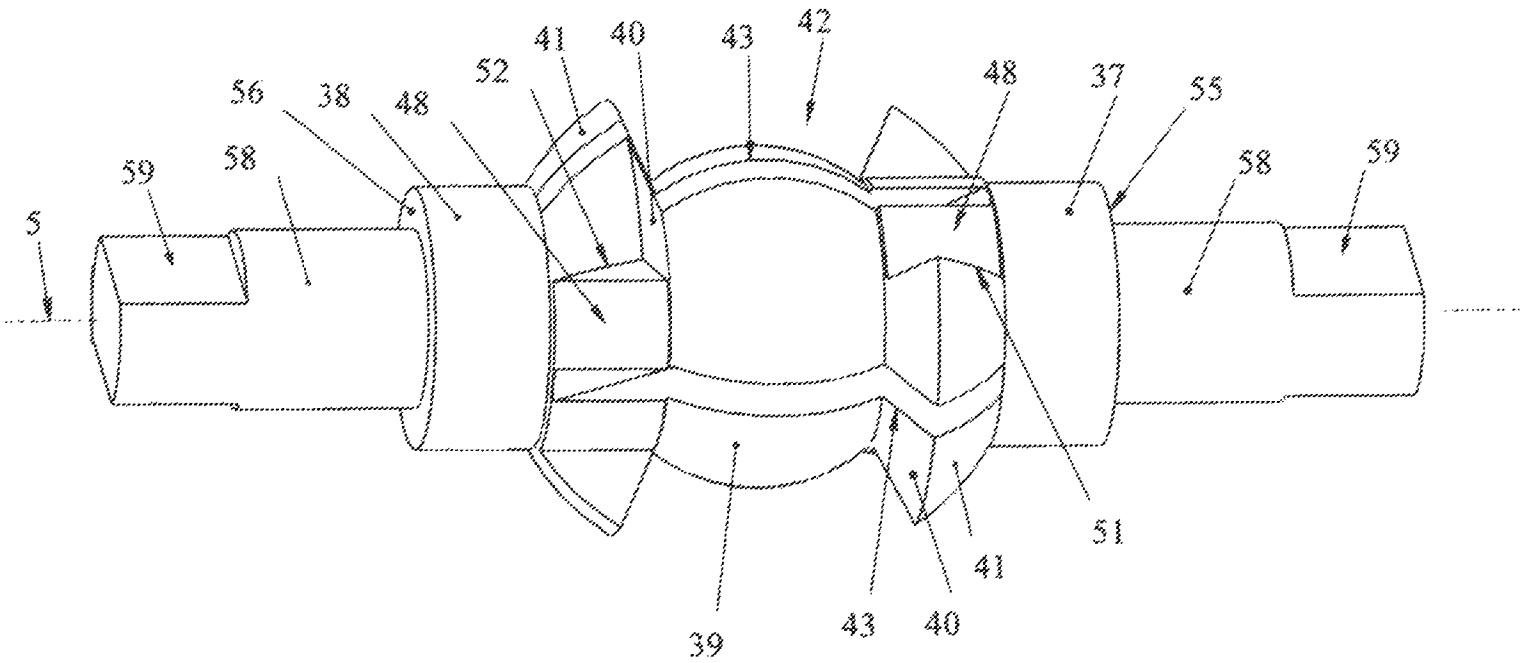
FIG. 36 shows a rotor of PDRM according to FIG. 34.

The rotor 4 (FIG. 36) is made on the one cylindrical shaft. The rotor 4 has the central ball-shaped part 39 with the center on the axis 5 and diameter close to the shaft diameter. The two side walls 40 are located from the opposite directions from it along the axis 5, the side walls 40 are manufactured as truncated cones which are coaxial to the axis 5 and symmetrically rested by their smaller base standings to the ball-shaped part 39. The side walls 40 are connected with the sections 37 and 38 of the cylindrical shaft by the transitions 41 having sphere-like surfaces the diameter of which is lager than the shaft diameter, and the centers coincide with the center of the ball-shaped part 39. Between two side walls 40 opened outwards the ring cavity 42 is formed, which bottom is the surface of the ball-shaped part 39. Along the axis 5 through the side walls 40, through transition sections 41, over the ball-shaped part 39 the two symmetrical c-shaped open-ended and turned by 180 degrees in its plane and by ¼ revolution relative to the axis 5 grooves 43 for the pistons 6 are passing. The groove 43 gets in the not large depth into the ball-shaped part 39 as a ring groove center of which is coinciding with the center of the ball-shaped part 39, is passing through the truncated cone of one of the side walls 40, is touching a little bit the truncated cone of the other side wall 40 (for mounting of the piston 6). The end faces 44 of the groove 43 are flat and parallel to the axis 5. Each groove 43 divides the side wall 40 on two equal parts, through which symmetrically relative to the groove 43, over the surface of the side walls 40 and transition surfaces 41 over the surface of the rotor 4 the ducts 48 for the working fluid are passing. We will call the outlines of the ducts 48 on one of the surfaces 41 the openings 51 and on the other surface 41 —the openings 52. The openings 51 and 52 have the angular length around the axis 5 less than ¼ of revolution and their sizes are approximately equal to the sizes of the openings 20 and 23 on the housing 3. The two openings 51 are located symmetrically relative to the axis 5 and tow openings 52 are located symmetrically with the turn by ¼ resolution.

The end faces 55 and 56 of the sections 37 and 38 serve correspondingly as axial bearings limiting the rotor 4 movements in the axial direction. The output shafts 58 are extending from the end faces 55, 56. One of them is working for connection with the drive and the other for connection of auxiliary equipment. The flats (splines) 59 are made on the output shafts 58.

The piston 6 (FIG. 37) is made as a part (a little bit smaller than a half) of a flat ring. The end faces 74 of the ring are flat, the outer side 75 is limited by the sphere-like surface with the diameter close to the diameter of the cavity 11 for possibility of rotating of the latter without large gaps. The surface of the ring hole 76 is cylindrical. The piston 26 can be divided conventionally on the inner (the nearest to the ring axis) part 77 and outer (peripheral) part 78. The inner part 77 does not get out of the groove 43. The two coaxial hinge joint 129 are made symmetrically on the outer part 78. The hinge joint 129 is made as the through arc-shaped slot 130 which axis 67 is passing through the center (the axis of rotary oscillations) of the piston 6. The slot 130 is passing front the inner part 77 up to the side face 75. The slot 130 is limited from one side by the concave cylindrical area 69 that is similar to the area 69 of the separator according to FIG. 7, from the other side by sector (part) of the cylinder 131 the angular dimension in the embodiment of 300 degrees.

The diameter of the sector (part) of the cylinder 131 is equal in this embodiment to the thickness of the piston 6. The chamfers 147 are made on the corners of the surface of the hole 76 (ring sector) to simplify the mounting into the groove 43 during assembly.

Figure 38:
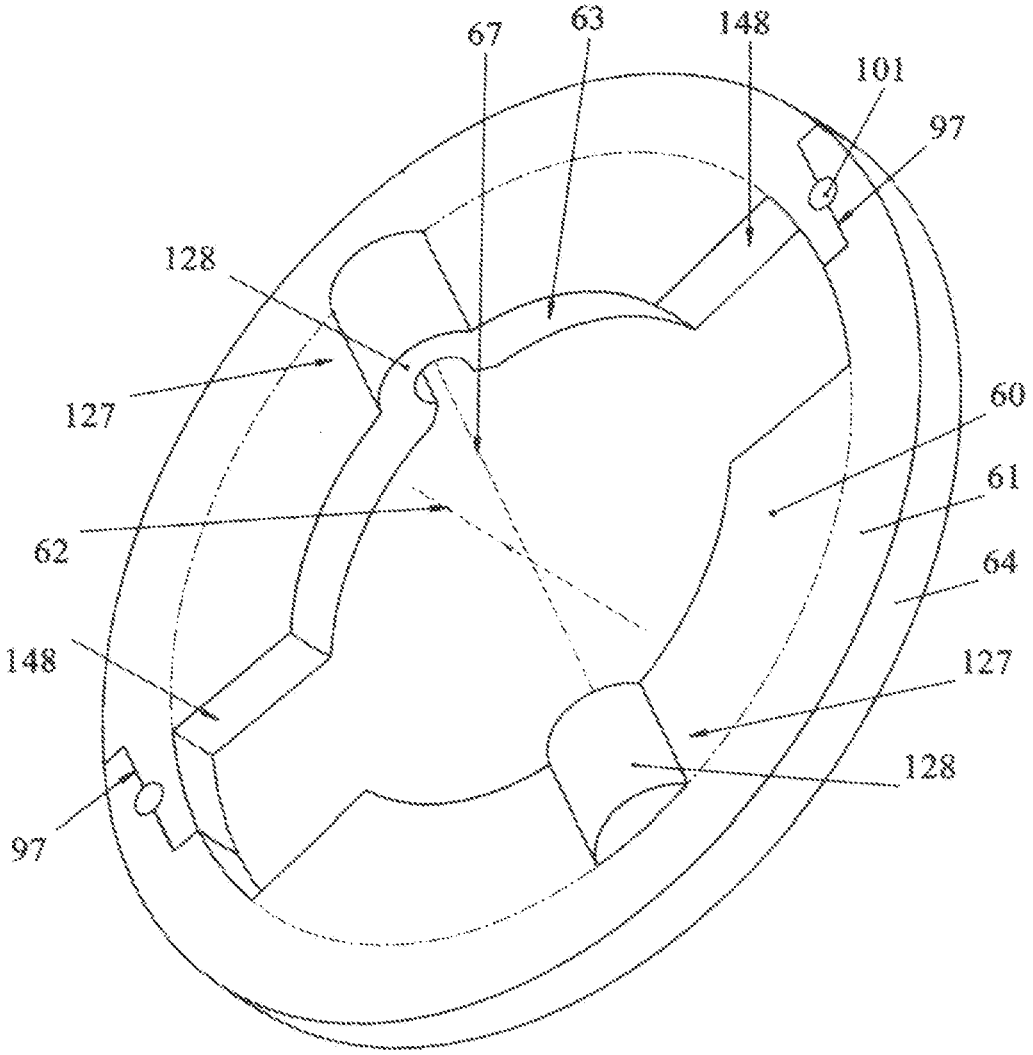
FIG. 38 shows the main part of the separator of the PDRM according to FIG. 34.

The separator 7 (FIG. 38) has the form of the body of revolution—symmetrical ring. Conventionally one can mark on it the inner (i.e. closer from its center) part 60 and outer (i.e. farther from its center) part 61. They are separated on the figure by line-and-dash circle. The outer part 61 in the assembles PDRM is located in the groove 15, and the inner part 60 is located in the cavity 11. The axis 62 is the axis of revolution of generatrix of the ring. The central hole 63 in the ring is limited by the sphere-like surface having the diameter close to he diameter of the ball-shaped part 39 of the rotor 4 to mount the separator 7 on it with minimal gap what allows their relative rotation. The outer side face 64 of the ring is limited by the sphere-like surface concentric to the central hole 63 which diameter is close to the diameter of the sphere-like surface 16 of the groove 15. The end faces 66 of the separator 7 are flat. The outer part 61 serves for interaction with the groove 15 of housing 3 and the two coaxial hinge joints 127 are made axis-symmetrically on the inner part 60. The hinge joint 127 is made as the local arc-shaped bent 128 of the separator 7 which axis is passing through the center of the separator 7. The bent 128 is passing through the whole inner part 60 of the separator 7. There is the sector of the ring on the local sectional view 128. Its angular dimensions in this embodiment are: 250 degrees at inner curve and 130 degrees at outer curve. Two through grooves 148 are performed symmetrically to the axis of the hinge joint 127 through the whole inner part 60 of the separator 7. The groove 148 is limited by the sphere-like surface concentric to the hole 63 and by the two flat almost radical area. The grooves are served for the mounting into them of the movable relative to the main separator 7 parts 146 of the separator 7.

Figure 39:
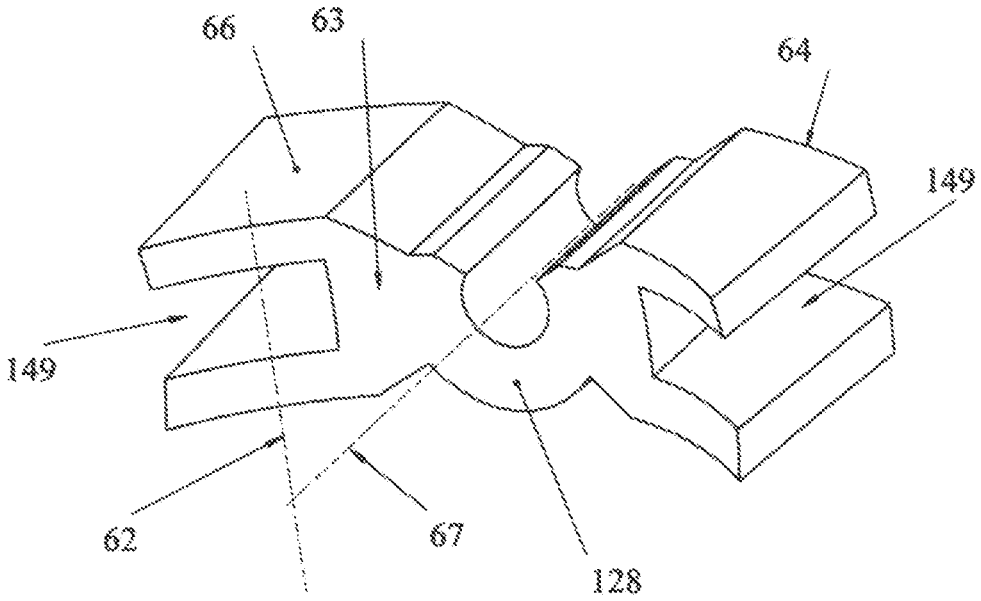
FIG. 39 shows the movable (relatively tot he main part of the separator) part of the separator of PDRM according to FIG. 34.
Figure 40:
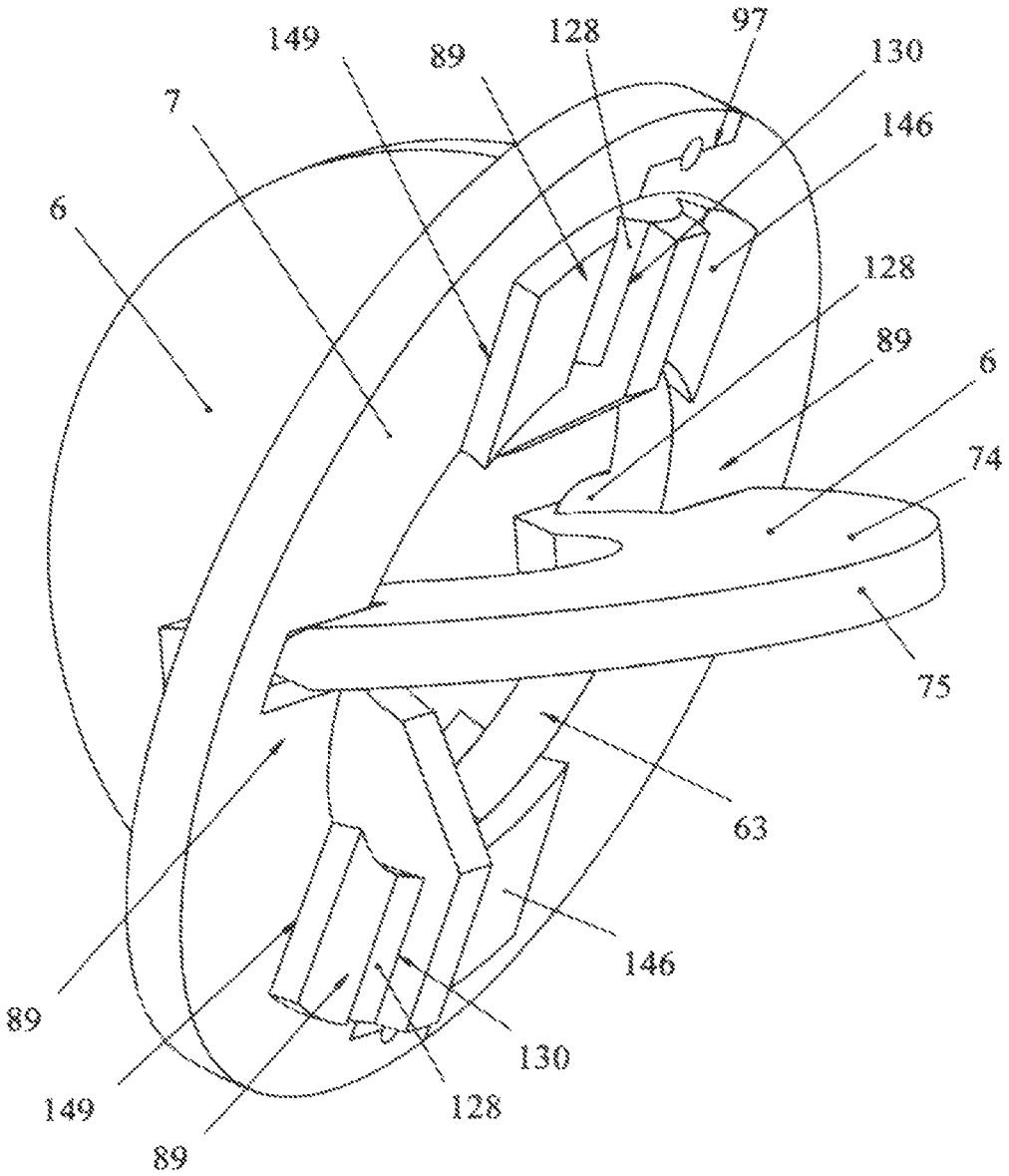
FIG. 40 shows the interaction of the pistons, the main part of the separator and movable part of the separator of PDRM according to FIG. 34.

The movable part 146 of the separator (FIG. 39) has the form of a small sector of the ring. The axis 62 is the axis of revolution of its generatrix. The central hole 63 in the ring is limited by the sphere-like surface having the diameter close to the diameter of the ball-shaped part 39 of the rotor 4. The outer side face 64 of the ring sector is limited by the sphere-like surface concentric to the central hole 63 which diameter is close to the diameter of the sphere-like cavity 11. The end faces 66 are flat. The hinge joint 127 is performed symmetrically on the part 146 in the form of a local arc-shaped bent 128 which axis 80 is passing through the center of the part 146. The thickness of the part 146 is lager than the thickness of the separator 7. The rectangular grooves 149 are made at its ends for mating with the main separator 7. The grooves 149 let the turn of the movable part 146 of the separator relative to the main separator 7 at a small angle (±3 degrees in this embodiment) around the axis 42 for compensation of the angle changing between the axis 80 of the different pistons 6 by rotating of the rotor 4.

An additional separator 7 (as on the FIG. 38) can be used instead of the movable parts 146 of the separator 7 instead of the through groove 148 so the part 146 will not fulfill the described function of the separator and can be called according to the vocabulary from the analogy as sealing forced element (SFE). Thus for mounting of several pistons around one ball-shaped part of the rotor 4 the combination for using as the hinge joints 89 between the piston 6 and separator 7 so the using of SFE are allowed.

Figure 34:
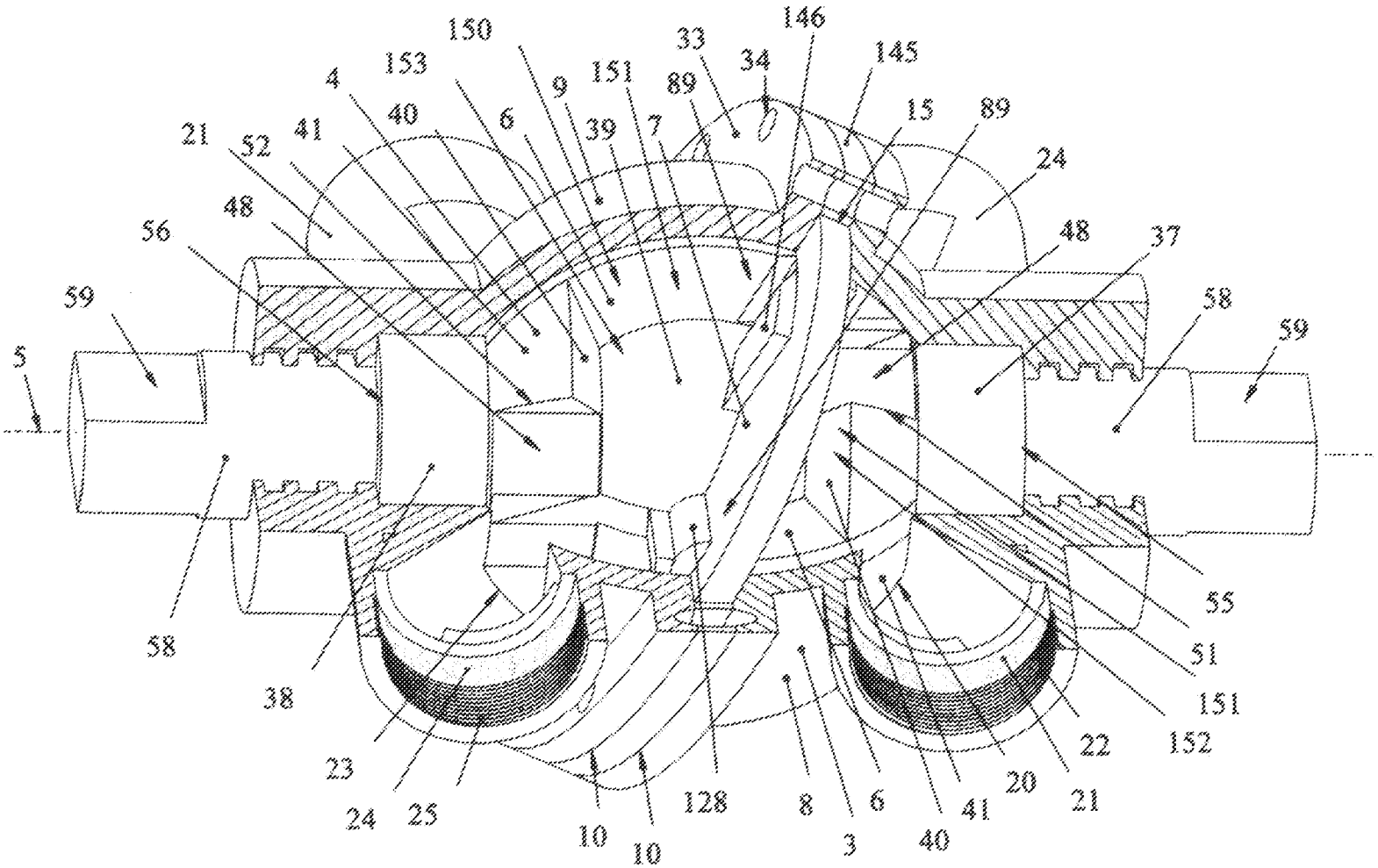
FIG. 34 shows the PDRM with a uniform feed in one stage.
Figure 35:
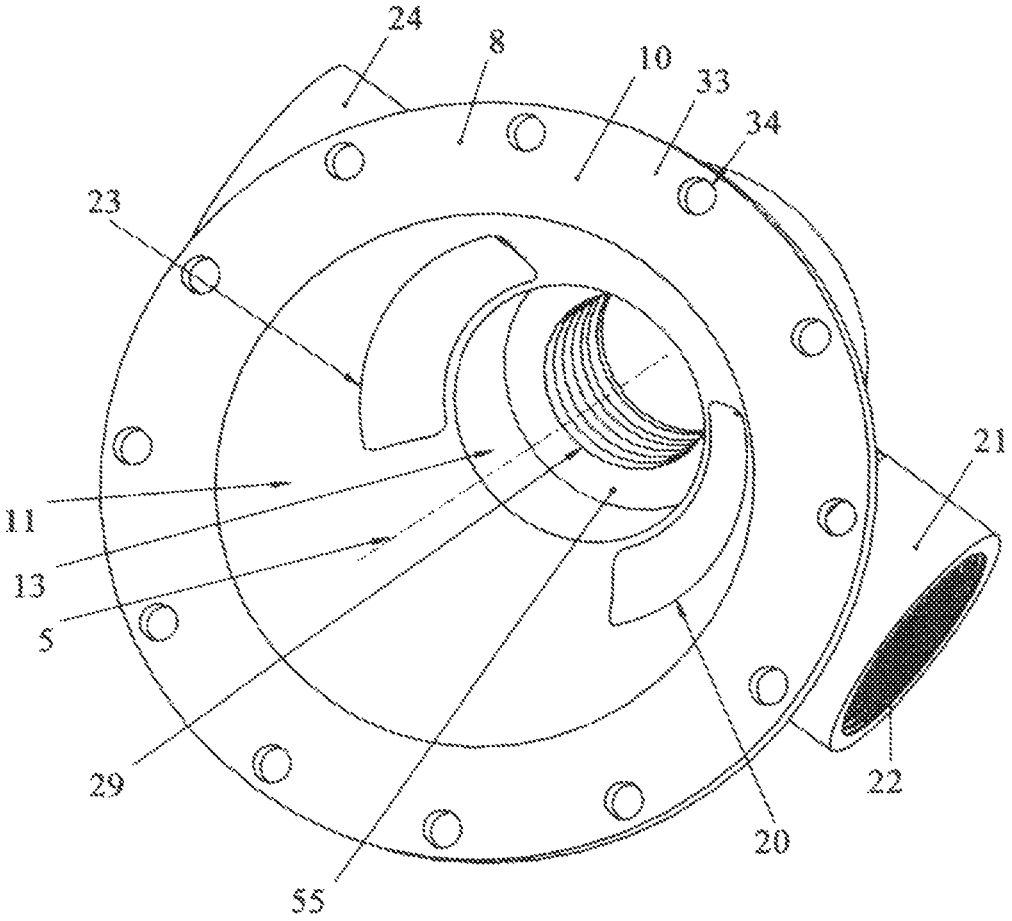
FIG. 35 shows a housing part of PDRM according to FIG. 34.

The machine according to the FIG. 34 is similar to the machine according to the FIG. 1 in operating principle, therefore it can be made controllable by the angle variation of the separator 7, similarly to the machine according to FIG. 27.

The reliable synchronization of the piston 6 was appeared in the machine according to the FIG. 34 in comparison with the analog (U.S. Pat. No. 2,708,413) due to the hinge joint 89 and the possibility was appeared to increase the inlet openings 20 and the outlet openings 23 due to their connection with the working chambers not directly but through the ducts 48.

The represented two types of the hinge joint 127-129 and 65-79 are interchangeable in the most cases and can be used in all represented machines.

Figure 19:
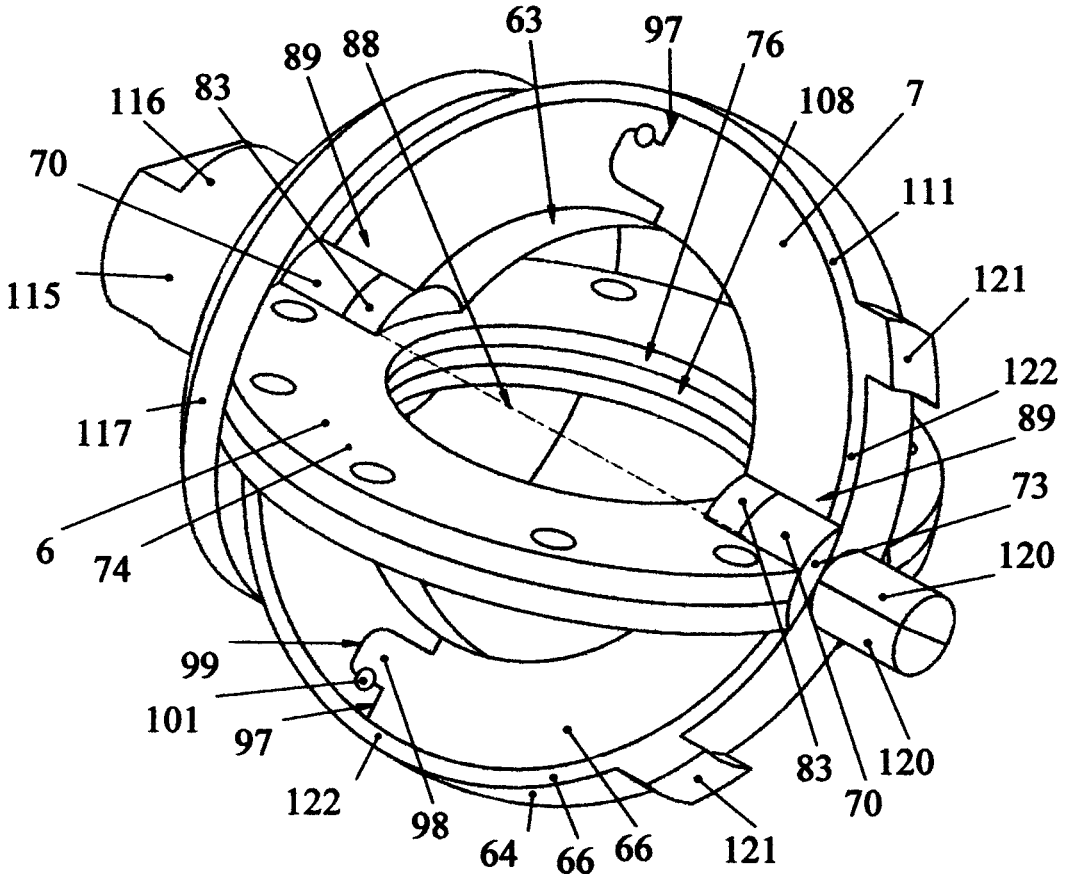
FIG. 19 shows an assembly of the PDRM consisting of the piston, separator and turnable shaft for usage in the PDRM with controlled feed.
Figure 20:
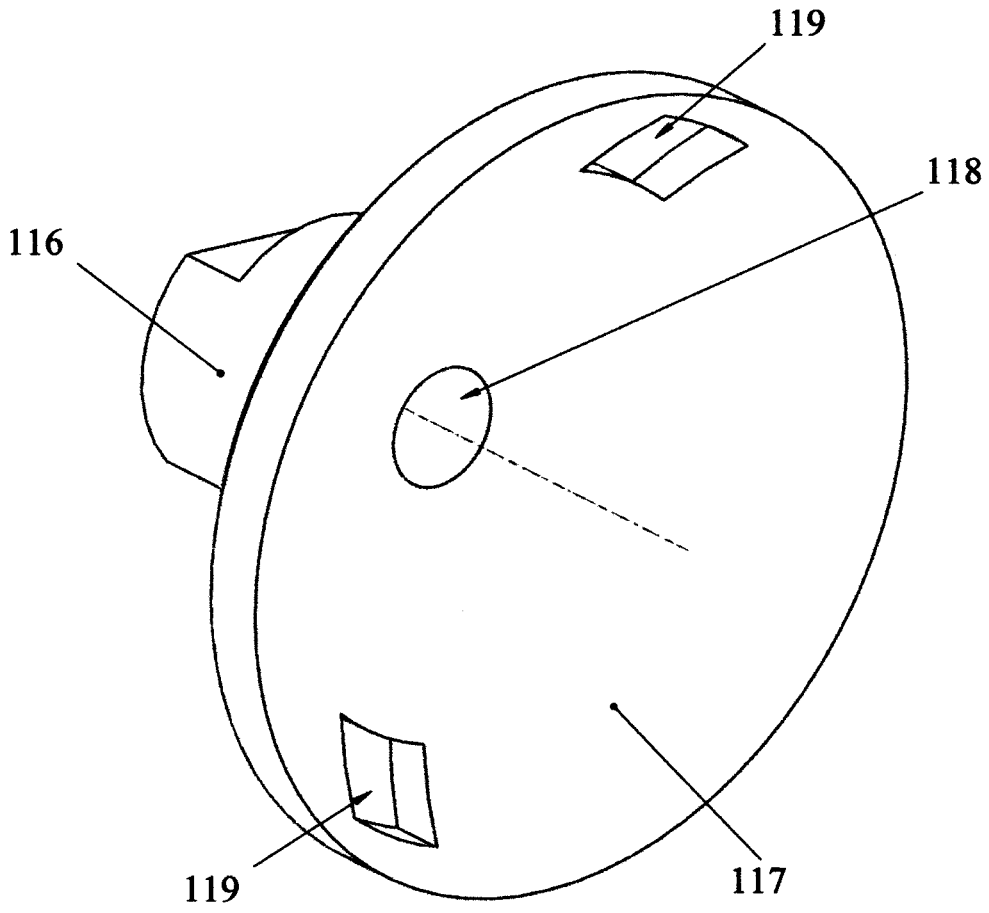
FIG. 20 shows a turnable shaft.
Figure 21:
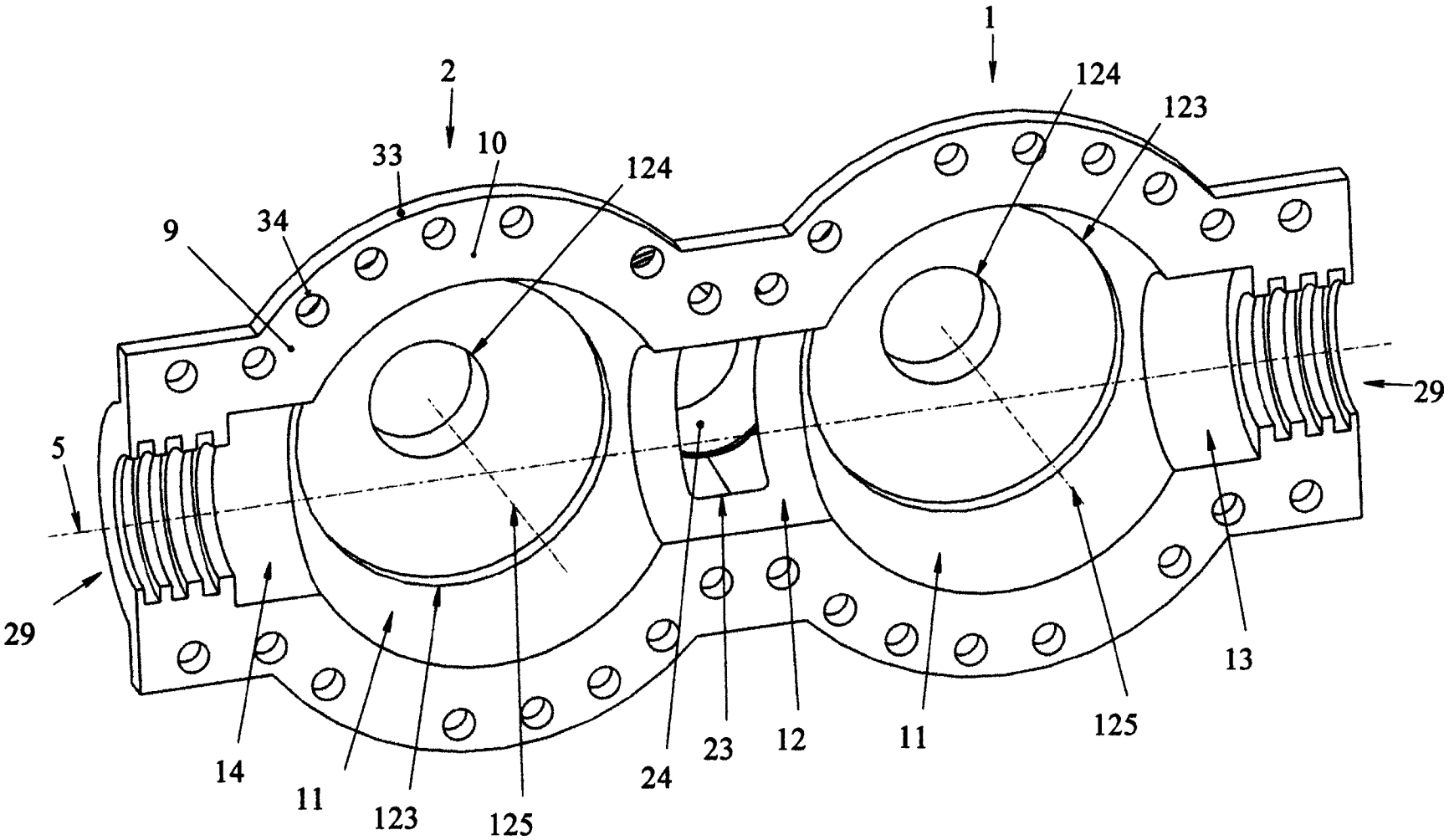
FIG. 21 shows a housing part of the PDRM with controlled feed.

In the machines according to the FIG. 1 and the FIG. 19-21 similar to the machine according to the FIG. 34 it can be no ducts 49 inside the rotor 4. But the passage of the working fluid inside the ball-shaped part 39 increases considerably (by approx. 3 times) the specific parameters of the PDRM. I.e. the considerable result is achieved due to the fact that the working fluid is passing inside the rotor through the existing there ducts 49/134.

In the machines according to the FIG. 1, FIG. 19-21 and FIG. 34 the side walls 40 of the rotor 4 and end faces 66 of the separator 7 do not interact with each other (in contrast to the outwardly similar analogous machine RU 2006119356) and do not have any strict limitations for the form. The convenient forms for manufacturing are chosen for them. The forms of the ducts for passage of the working fluid do not have also any strict limitations.

The form of the outer side face 64 and side surface 16 of the groove 15 should not be obligatory sphere-like. They can have the form of another surface of revolution, for example, cylindrical or not be the surface of revolution, i.e. the gape (spaces) between them can be large enough to exclude their interaction. It increases the possibilities of groove 15 manufacturing. The separator 7 is fitted in the required place in the cavity 11 due to interaction with the ball-shaped part 39 of the rotor 4. The present of the gape between them allows to simplify their manufacture.

The sphere-like transition surface 41 on the rotor 4 can be replaced by any other surface of revolution and can disappear due to increasing of the diameter of the sections 36, 37, 38.

With the sufficient safety factor of the rotor 4 the side walls 40 can have cylindrical surface which is an extension of the shaft areas 36, 37, 38 surfaces. I.e. geometrically (visually) two elements can be excluded—the side walls 40 and the transition surface 41.

To increase the reliability and strength all immobile joints 97, 113 can be replaced by permanent, for example, welding joints.

The PDRM by FIG. 1 as a pump works in the following way. Around the sphere-like part 39 of the rotor 4 of each of the stages 1, 2 in the cavities 11 of housing 3 from the opened ring cavity 42 formed a ring working cavity 143, which the separator 7 divides into two parts 144 of variable cross section. The piston 6 divides each part 144 into two working chambers 152 and 153. Rotation of the piston 6 with the rotor 4 via hinge 89 between the piston 6 and the separator 7 draw into rotation the separator 7. During rotation of the rotor 4 the working chambers 152, 153 change their volume because of the separator 7 inclination. Two central symmetrically located relatively to sphere-like part 39 chambers 152 are increasing their volume, at the same time as two other central symmetric chambers 152 are decreasing their volume. Chambers 152/153 situated on the other from the area 36 side of the separator 7 due to the screw ducts 49 inside the sphere-like part 39 together with the chambers 152/153 located from the side of area 36 are connected by ducts 50 with the opening 51 and 52 situated at the area 36 of the rotor 4 between the stages 1 and 2. At this place at the housing 3 the inlet opening 20 and axis symmetrically to it regarding axis 5 of rotor 4 rotation the outlet opening 23 of working fluid are located. Outlets of the ducts 50 to the rotor 4 surfacing coming from increasing their volume chambers 152 overlap with opening 20, and outlets of the ducts 50 to the rotor 4 surface coming from decreasing their volume chambers 153 overlap with opening 20. Due to decrease of the chambers 153 volume, the working fluid from them have to go out through ducts 49, 50 to outlet opening 23 and further to the outlet branch pipe 24. Due to increase of the other chambers 152 volume, a new portion of working fluid enters them through 50, 49 through inlet opening 20 and from the inlet branch pipe 21.

When the volume of chambers 153 of one of the stages 1/2 reaches the minimum, and the volume of other chambers 152 reaches the maximum, the outlets 51/52 of the ducts 50 due to the rotor rotation comes out of overlapping with the outlet opening 23 and with the inlet opening 20 respectively and start to enter in overlapping with the opposite openings—the inlet opening 20 and outlet opening 23 respectively. Pairs of the chambers 152 and 146 change each other. The process is repeated. Due to the shift in faze in ¼ of revolution between the stages 1 and 2, the total supply becomes closer to uniform (non pulsating).

The separator 7 is subjected to periodic axis symmetric load from the working fluid on its inner part 60, which its outer part 61 transfers to the end faces 17 of the groove 15. Since the direction of this force is perpendicular to the velocity of the separator 7, it does not transfer the torque and energy between the rotor 4 and the working fluid.

The piston 6 is subjected to the periodic central symmetric load from the working fluid on its outer part 78, which it transfers to the end faces 44 of the groove 15. Via the piston 6 the energy and torque transition between the rotor 4 and the working fluid occurs.

The piston 6 via hinge joint 89 transfers a part of energy of the rotor 4 to the separator 7 to compensate the friction forces acting on the separator 7 (mainly in the groove 15).

Besides because of rotational oscillations of the piston 6, it is subjected to inertial forces proportional to the integral of piston 6 masses multiplied by squared distances from them to axis 86 along the piston 6 plane. They are transferred via areas 82 to the thickening 70 of the separator 7, i.e. via hinge joint between the piston 6 and separator 7.

Because of small unsteadiness rotation of the separator 7, it is subjected to inertial forces which are proportional to its moment of inertia in its plane. They are transferred via areas 69 of the separator 7 to the thickenings 83 of the piston 6, i.e. via hinge joint between the separator 7 and piston 6.

Areas 82 and areas 69 are almost perpendicular to the transferred by them forces.

Rotor 4 is balanced regarding to radial forces acting on it from the working fluid. Not balanced moment of forces significantly decreased due to the distance between areas 37 and 38 playing the role of bearings.

The PDRM by FIG. 19-21 works in the similar with PDRM by FIG. 1 way. Additionally it gains the ability to vary its feed from the maximal feed in one direction to the same feed in the opposite direction while the rpm of the rotor is constant. It takes place when simultaneously the turnable shafts of both stages are turning on by an external control drive in the range of angles from −25 to +25 degrees around the axes 125.

The PDRM by FIG. 27 as a pump works in the following way. Around the sphere-like part 39 of the rotor 4 of each of the stages 1, 2 in the cavities 11 of housing 3 from the opened ring cavity 42 formed a ring working cavity 150, which the separator 7 divides into two parts 151 of variable cross section. In the narrow place the cross section is equal to zero. I.e. the part 151 is c-shaped (does not form a ring). The piston 6 divides each part 144 into two working chambers 152 and 153. Rotation of the piston 6 with the rotor 4 via hinge joint 89 between the piston 6 and the separator 7 draw into rotation the separator 7. But the rotation of the separator 7 does not move the parts 151 relatively to the housing 3. During rotation of the rotor 4 one part of the piston moves in one part 151 dividing it into chambers 152 and 153. The chambers 152 are situated behind (along the direction of rotor 4 rotation) the piston 6 and increasing their volume, and chambers 153 are situated beforehand the piston 6 and decreasing their volume. The working fluid from ducts 134 inside the rotor 4 through inlet opening 137 on rotor 4 located behind the piston 6 passes into the chambers 152. And from the chambers 153 the working fluid passes out through opening 138 located before the piston 6 to the other duct 134. When the piston 6 reaches the minimal cross section of the one of the parts 151 after passing it the piston 6 enters into the same part 151 but from the other side. The process is repeated. The ducts 134 pass the working fluid between the outlet opening 138 of one stage 1 and the inlet opening 137 of the other stage 2 or between the inlet branch pipe 21/outlet branch pipe 24 and inlet opening 20 of the stage 1/outlet opening 23 of the stage 2 through openings 140. The feed of the PDRM is close to uniform.

The separator 7 is subjected to the periodic circular moving pulsating load from the working fluid on its inner part 60 which its outer part 61 transfers to the end faces 17 of the groove 15. Since the direction of that force is perpendicular to the velocity of the separator 7, it does not transfer the torque and energy between the rotor 4 and the working fluid. Excluding the stage pressure drop acting on the cross section of the separator 7 and pushing it in the direction of its rotation.

The piston 6 is subjected to periodic central symmetric load from the working fluid on its outer part 78 which it transfers to end face 44 of the groove 43. via the piston 6 the energy and torque transfer between the rotor 4 and the working fluid is done. The piston 6 via the hinge joint 89 transfer a part of rotor 4 energy to the separator 7 for a compensation of friction forces acting on the separator 7 (mainly in the groove 15).

Besides because of rotational oscillations of the piston 6 it is subjected to inertial forces proportional to the integral of piston 6 masses multiplied by their squared distance to the axis 86 along the piston 6 plane. They are transferred via the bent 128 on the piston 6 to the cylinder sector 131 of the separator 7, i.e. via hinge joint 89 between the piston 6 and separator 7.

Because of small non uniformity of the separator 7 rotation it is subjected to the inertia forces proportional to its inertia moment taken in its plane they are transferred via areas 69 of the separator 7 to the bent 128 of the piston 6, i.e. via hinge joint 89 between the separator 7 and piston 6. On the hinge joints 89 there are areas practically perpendicular to the forces transferred through them.

The PDRM by FIG. 34 as a pump works in the similar with the PDRM by FIG. 1 way. Around the sphere-like part 39 of the rotor 4 in the cavities 11 of housing 3 from the opened ring cavity 42 a ring working cavity 150 is formed, which the separator 7 along with the movable parts 146 of the separator 7 divides into two parts 151 of variable cross section. Each piston 6 divides each part 151 into working chambers 153 and 153. Rotation of the piston 6 with the rotor 4 via hinge 89 between the piston 6 and the separator 7 draw into rotation the separator 7. Rotation of the other piston 6 with the rotor 4 via hinge joints 89 between the piston 6 and movable parts 146 of the separator 7 draw the latter into rotation. During rotation of the rotor 4 the working chambers 151. 153 change their volume due to the separator 7 inclination. One chamber 152 is increasing its volume, at the same time as the chamber 153 located from the other side of the piston 6 is decreasing its volume. Chambers 152/153 situated on the other from the separator 7 side and separated by the other piston 6 due to the turning angle of ¼ revolution around 5 between pistons 6 are shifted in faze at 90 degrees.

When the volume of the chamber 151 is increasing it is connected by duct 48 with the inlet opening 20 of the working fluid, and from the inlet branch pipe 21 through openings 20 and 50/51 the working fluid is coming into it. When the volume of the chamber 152 is decreasing it is connected by duct 48 with the outlet opening 23 of the working fluid, and the working fluid is coming out from it to the outlet branch pipe 24 through the openings 23 and 51/52. When the minimal or the maximal volume is reached by the chambers 152/153 the switch in their commutation occurs. The process is repeated for the other chambers 152/153. Due to the shift in faze between the pares of chambers 152/153, the feed of the PDRM is closer to uniform.

The invention claimed is:

1. Positive-displacement rotary machine comprising:

a housing, a rotor, a piston, a separator, a sphere working cavity formed around the rotor, inlet openings and outlet openings working fluid, wherein at least a part of the piston (78) is mounted for accomplishing rotary oscillations relative to the rotor in a plane positioned mainly along a rotor axis and at least a part of the separator is mounted with the rotation around the rotor, and the piston or the part of the piston makes at least one hinge joint with the separator or with the part of the separator.

2. Positive-displacement rotary machine according to claim 1, in which the hinge joints on the piston and on the separator are made as a combination of a cylindrical thickening and a slot with coaxial to the thickening convex cylindrical areas.

3. Positive-displacement rotary machine according to claim 1, in which the hinge joint on the piston is made in the form of an arc-shaped bent and the hinge joint on the separator is made in the form of arc-shaped slot.

4. Positive-displacement rotary machine according to claim 1, in which the hinge joint on the piston is made in the form of an arc-shaped slot and the hint joint on the separator is made in the form of arc-shaped bent.

5. Positive-displacement rotary machine according to claim 1, in which at least two working chambers (152, 153) are formed by the piston and the separator in the working cavity and ducts for working fluid inside the rotor are leading from an one side to another side of the separator to make it possible to supply and discharge the working fluid to/from the working chambers only from one side of the separator.

6. Positive-displacement rotary machine according to claim 1, in which the separator is mounted with the possibility of variation of a separator angle to rotation axis of the rotor to control the machine feed.

7. Positive-displacement rotary machine according to claim 1, in winch there is a ball-shaped part (39) positioned concentrically in the sphere working cavity, and the inlet opening and the outlet opening made at the ball-shaped part at different sides of the piston.

8. Positive-displacement rotary machine according to claim 1, in which the separator has a part 122 rotating around the rotor and a static part (111 and 112) which reduces the load of the rotating part.

9. Positive-displacement rotary machine according to claim 1, in which there is an additional piston and the separator contains movable parts (113) for interaction with the additional piston.

10. Positive-displacement rotary machine comprising:

a housing with sphere cavity, a rotor with a ball-shaped part, a piston, a separator with a hole the ball-shaped part, a sphere working cavity formed in the sphere cavity around the ball-shaped part of the rotor, inlet openings and outlet openings for working fluid, at least a part of the piston is mounted for of accomplishing rotary oscillations relative to the rotor in a plane positioned along the rotor axis and at least a part of the separator is mounted with the rotation around the rotor and with maintaining the inclination angle of a plane of the rotation to the rotor axis, wherein the piston or its part is lined by a hinge joint with the separator or its part and a hinge joint axis pass through the center of the sphere cavity.

11. Positive-displacement rotary machine according to claim 10, in which working chambers are formed by the piston and the separator in the working cavity and inside rotor ducts for working fluid are made leading from an one side to another side of the separator to make it possible to supply and/or discharge the working fluid to/from the working chambers only from one side of the separator.

* * * * *